US005245386A

United States Patent [19]

Asano et al.

[11] Patent Number: 5,245,386

[45] Date of Patent: Sep. 14, 1993

[54] CONTACT CHARGING DEVICE HAVING A BRUSH RESTRICTING MEMBER

[75] Inventors: Masaki Asano, Amagasaki; Shuji Iino, Hirakata; Akihito Ikegawa, Sakai; Izumi Osawa, Ikeda, all of Japan

[73] Assignee: Minolta Camera Kabushiki Kaisha, Osaka, Japan

[21] Appl. No.: 842,925

[22] Filed: Feb. 27, 1992

[30] Foreign Application Priority Data

| | | | |
|---|---|---|---|
| Mar. 1, 1991 | [JP] | Japan | 3-36212 |
| Mar. 4, 1991 | [JP] | Japan | 3-37496 |
| Mar. 4, 1991 | [JP] | Japan | 3-37497 |
| Mar. 6, 1991 | [JP] | Japan | 3-40080 |

[51] Int. Cl.[5] ..... G03G 15/02

[52] U.S. Cl. ..... 355/219; 361/225

[58] Field of Search ..... 355/219, 221, 210, 202; 361/221, 225, 220; 430/902

[56] References Cited

U.S. PATENT DOCUMENTS

| | | | |
|---|---|---|---|
| 4,387,980 | 6/1983 | Ueno et al. | 118/651 X |
| 4,457,615 | 7/1984 | Seanor | 118/652 X |
| 4,761,709 | 8/1988 | Ewing et al. | 361/225 |
| 5,060,016 | 10/1991 | Wanou et al. | 355/219 |
| 5,081,504 | 1/1992 | Morisawa et al. | 355/299 |

FOREIGN PATENT DOCUMENTS

| | | |
|---|---|---|
| 61-105566 | 5/1986 | Japan . |
| 62-134660 | 6/1987 | Japan . |
| 3-4235 | 1/1991 | Japan . |

*Primary Examiner*—A. T. Grimley
*Assistant Examiner*—Thu Dang
*Attorney, Agent, or Firm*—Burns, Doane, Swecker & Mathis

[57] ABSTRACT

A contact charging device for charging a moving surface of an electrostatic latent image support member includes a large number of brush hairs contacting the moving surface of the electrostatic latent image support member; a brush restricting member, which is disposed upstream to the brush hairs in a moving direction of the surface of the electrostatic latent image support member and contacts the brush hairs; and a brush holder member holding the brush hair group, the holder member being electrically coupled to a power supply to apply a voltage to the brush hairs.

25 Claims, 23 Drawing Sheets

CONTACT CHARGING DEVICE HAVING A BRUSH RESTRICTING MEMBER

BACKGROUND OF THE INVENTION

1. Field of the Invention

The present invention relates to charging devices used in image forming devices such as copying machines and printers for electrically charging surfaces of electrostatic latent image support members.

2. Description of the Related Art

In the image forming devices such as copying machines and printers, the charging devices charges the electrostatic latent image support members such as photosensitive drums to form charged areas, which will be subjected to image exposure to form electrostatic latent images. The latent images are developed into visible images, which are transferred onto transfer members and are fixed thereon.

Various types of charging devices have been known, and can be basically classified into two types, i.e., corona charging devices utilizing corona discharging and contact charging devices in which charging brushes, charging rollers or rotary endless charging belts contact surfaces of the electrostatic latent image support members.

Although the charging device utilizing the corona discharging has an advantage that stable charging can be carried out, it causes generation of a large amount of ozone, which may deteriorate the electrostatic latent image support member and adversely affect human bodies. Therefore, attention has been given to the contact charging device because it generates remarkably less amount of ozone as compared with the corona charging device.

Especially, the attention has been given to such a brush charging device having a stationary charging brush which contacts a moving surface of the electrostatic latent image support member for charging the same because of its relatively simple structure.

In a general structure thereof, as shown in FIG. 1, a large number of brush bristles or hairs F are attached to electrically conductive base cloth A, which is fixed to back plate P of, e.g., aluminium by adhesive or the like. A brush B to which a voltage is applied by a charging power supply PS contacts a moving surface S of an electrostatic latent image support member PC to charge the surface of the support member.

However, the above brush charging device has following disadvantages. In the charging brush B, it is ideal that an upstream end B1 thereof in a moving direction X of the surface S of the latent image support member as well as opposite ends B2 of the brush in a direction Y (widthwise direction of the device) crossing the direction X are aligned or trimmed, as shown in FIG. 1. However, as shown in FIG. 2, these portions are actually liable to be disarranged such that a portion (a) of the upstream end B1 of the brush projects to the upstream side, and another portion (b) is disarranged relatively to the downstream side. Similarly, the opposite ends B2 may be disarranged in the widthwise direction Y of the device.

The disarrangement of the charging brush may often be caused by the grouping of the brush hairs due to use for a long term. The cause of the grouping is generally considered to be the mutual adhesion of the brush hairs, which may be caused by adhesion of toner component, paper dust and/or oil component in the fixing device to the brush hairs. Generally, the brush hairs are fixed by pile units each including a bundle of brush hairs, and thus it is considered that the grouping is liable to be caused in each bundle of the pile unit. Further, the grouping also may be caused by deformation of the brush hairs due to heat, pressure, vibration or the like which has been applied to the brush hairs for a long term.

If the charging brush B is disarranged in the moving direction X of the surface of the electrostatic latent image support member as described above, charging is caused in the convex portion (a) prior to the charging in the concave portion (b) by the Paschen's law. Due to this influence, a portion corresponding to the concave portion (b) around the portion (a) is charged to some extent. Therefore, in the concave portion (b), a potential difference between the charging brush B and the electrostatic latent image support member cannot reach a discharge threshold voltage according to the Patchen's law, and thus the discharging is not caused. Consequently, irregular charging is caused in the widthwise direction Y of the electrostatic latent image support member, and dark and light noise of a striped form is generated in the finally obtained image due to the irregularly charged pattern.

Also, the disarrangement of the brush at the opposite ends B2 in the widthwise direction Y of the charging device may correspondingly cause the striped noise in the image. The brush having the disarranged ends B2 are liable to contact the portions, which do not bear photosensitive layers and are located at ends in the widthwise direction of the electrostatic latent image support member. This may cause escape and drop of the voltage. In order to prevent this, the area bearing the photosensitive material must be sufficiently large in the widthwise direction, which increases the manufacturing cost of the electrostatic latent image support member.

The Japanese Laid-Open Patent Publication No. 61-105566 (105566/1986) has taught a support plate, which serves as means for preventing the toppling or inclining of the charging brush hairs and supports the downstream end of the charging brush in the moving direction of the surface of the electrostatic latent image support member. This support member, however, is aimed to prevent smear of the charging brush, as described in the publication, and cannot prevent the striped noise in the image, to be solved by the present invention.

Further, the above problem relating to the striped noise may often caused if the brush hairs have circular cross sections, because such brush hairs contact the electrostatic latent image support member through an extremely small number of points and thus effective conductive portions cannot be stably obtained. That is; the charge cannot smoothly move from the brush hairs to the electrostatic latent image support member and thus the whole surface of the support member cannot be charged uniformly and stably. The discharging is carried out only through a small number of points, so that it is difficult to perform the sufficient charging, resulting in the striped noise descried above.

The Japanese Laid-Open Patent Publication No. 62-134660 (134660/1987) has taught means for solving the above problems, in which carbon particles or the like are adhered to the surfaces of the charging brush hairs to form and disperse a large number of convex portions, i.e., conductive portions. These conductive portions are separated as the time elapses, and thus the stable charging cannot be performed for a long time of period.

The Japanese Laid-Open Patent Publication No. 3-4235 (4235/1991) has taught a construction in which hairs of a decharging brush are provided at their peripheries with uneven portions having, e.g., star-shaped cross sections. If such brush hairs were used for the charging purpose, fine powder such as fragments of toner particles, which were broken by a stress in a developing operation and/or an operation for cleaning up residual toner, would adhere to concave portions of the surfaces. This would deteriorate the charging capability of the brush hairs, resulting in reduction of the charging capability of the whole charging device. This also would cause the striped image noise due to the mixed state of the portions bearing the fine powder and the portions not bearing the same.

SUMMARY OF THE INVENTION

Accordingly, it is an object of the invention to provide a brush charging device having a charging brush, which contacts and charges a moving surface of an electrostatic latent image support member, and characterized in that disarrangement of the charging brush is prevented as far as possible, and thus a striped image noise can be prevented.

In accordance with the above object, the invention provides a brush charging device having a charging brush, which has many brush hairs contacting and charging a moving surface of an electrostatic latent image support member: the device comprising an upstream brush restricting member or an upstream support member, which support and align an upstream end, in a moving direction of the surface of the electrostatic latent image support member, of the charging brush for preventing disarrangement of the same.

The invention also provides a brush charging device having a charging brush, which has many brush hairs contacting and charging a moving surface of an electrostatic latent image support member; the device comprising side end brush restricting members or side end support members, which support and align opposite ends, in a direction crossing a moving direction of the surface of the electrostatic latent image support member, of the charging brush for preventing disarrangement of the same.

According to the brush charging device of the invention, if the upstream support member is associated to the charging brush, it aligns free ends of the brush hairs at the upstream end of the charging brush in the direction crossing the moving direction of the surface of the electrostatic latent image support member, so that discharging starts uniformly and simultaneously at respective positions in the crossing direction, which enables uniform charging of the surface of the electrostatic latent image support member without irregularity.

If the side end support members are associated to the charging brush, they align the free ends of the brush hairs in the widthwise direction of the charging brush in the moving direction of the surface of the electrostatic latent image support member, so that end portions of the latent image support member are uniformly charged. This construction also prevents the hairs at the end of the brush from contacting conductive portions, such as portions to which photosensitive layers are not applied, at the ends of a latent image support member, and further prevents leakage of the charge.

In view of another aspect, the present invention provides a brush charging device having a charging brush, which has many brush hairs contacting and charging a moving surface of an electrostatic latent image support member; the device comprising a brush restricting member or a support member, which support an end of the charging brush, the support member having an inner surface, which contacts the brush hairs and is shaped to be rough and uneven for preventing disarrangement of the end of the charging brush.

The brush end to which the support member is associated is one of upstream, downstream and opposite side ends of the charging brush. The unevenness of the inner surface of the support member is required to be formed to an extent which can prevent the disarrangement of the brush hairs. In view of ordinarily used brush hairs, it is preferable that a maximum surface roughness $R_{max}$ according to the JIS (Japanese Industrial Standard) B-0601-1970 is in a range from 2.0 to 40 μm. The uneven portions may be dispersed, or may be formed of, e.g., many concave and convex lines extending along a lengthwise direction of the brush hairs. The unevenness may have various forms.

According to the brush charging device of the invention, the ends of the brush hairs are aligned at the end of the charging brush to which the support member is associated. The support member has the uneven inner surface. Therefore, grouping of the brush hairs, which may be caused by vibration of the device and others, is prevented, and thus the surface of the electrostatic latent image support member is uniformly and regularly charged.

In view of still another aspect, the invention provides a brush charging device for charging a moving surface of an electrostatic latent image support member in an image forming apparatus, comprising a charging brush having a large number of brush hairs which contact and charge the moving surface, a holder member to which the charging brush is fixed, a holder member mounting portion provided in a main body of the image forming apparatus for removably mounting the holder member thereon, brush restricting means or support means which is provided at least one of the holder member and the holder member mounting portion for supporting a end of the charging brush; the brush support means being constructed such that the support member mounted on the support member mounting portion pushes and supports the end of the charging brush.

In view of further another aspect, the invention provides a brush charging device characterized in that brush hairs forming a charging brush are formed of fibers having convex polygonal sections.

The convex polygonal section has no concave portions and are defined by contours formed of only convex portions projecting outwardly, respectively. A number of the convex portions in each of the polygonal section is not restricted, but substantially and preferably is in a range from one to ten, and more preferably from two to five. The number larger than ten excessively approaches the polygon or the like to a circle, which reduces an expected effect for increasing charging points.

Material of the brush hairs according to the invention is not restricted to particular material. However, it is required to have appropriate electrical conductivity.

Such conductive material may be metal wires of tungsten, stainless steel, gold, platinum, iron, copper, aluminium and others.

Conductive resin material may be formed of fiber and resistance adjusting agent dispersed therein. The fiber may be formed of rayon, nylon, acetate, cuprammonium, vinylidene, vinylon, ethylene fluoride, promix, benzoate, polyurethane, polyester, polyethylene, polyvinyl chloride, polychlal, polynosic, polypropylene and others. The resistance adjusting agent may be carbon black, carbon fiber, metal powder, metal whiskers, metal oxide, semiconductor and others. An appropriate resistance may be obtained by adjusting the amount of the resistance adjusting agent dispersed in the fiber. Instead of dispersion, the surface of the fiber may be covered with the resistance adjusting agent.

The foregoing and other objects, features, aspects and advantages of the present invention will become more apparent from the following detailed description of the present invention when taken in conjunction with the accompanying drawings.

DESCRIPTION OF THE PREFERRED EMBODIMENT

Embodiments of the invention will be described below with reference to the figures.

Figure 1:
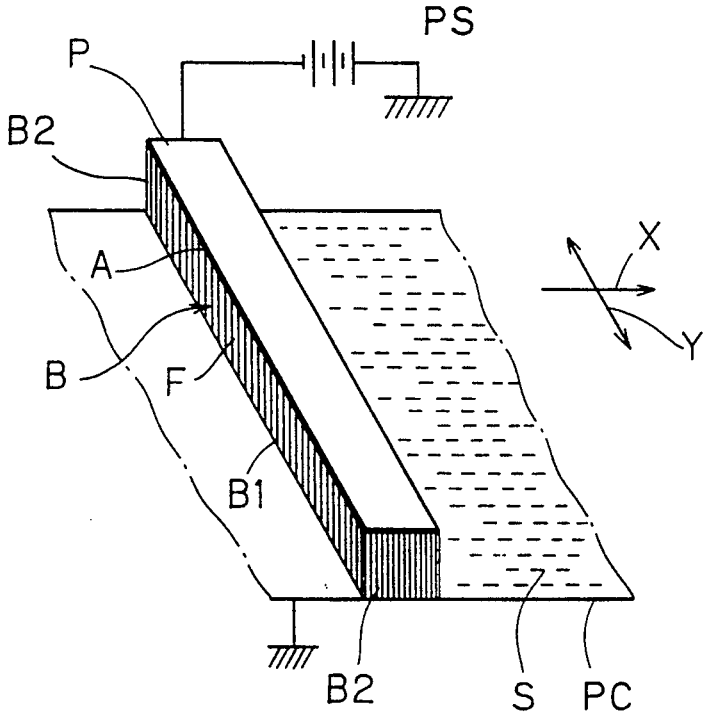
FIG. 1 (PRIOR ART)
FIG. 1 is a schematic view of a conventional brush charging device.
Figure 2:
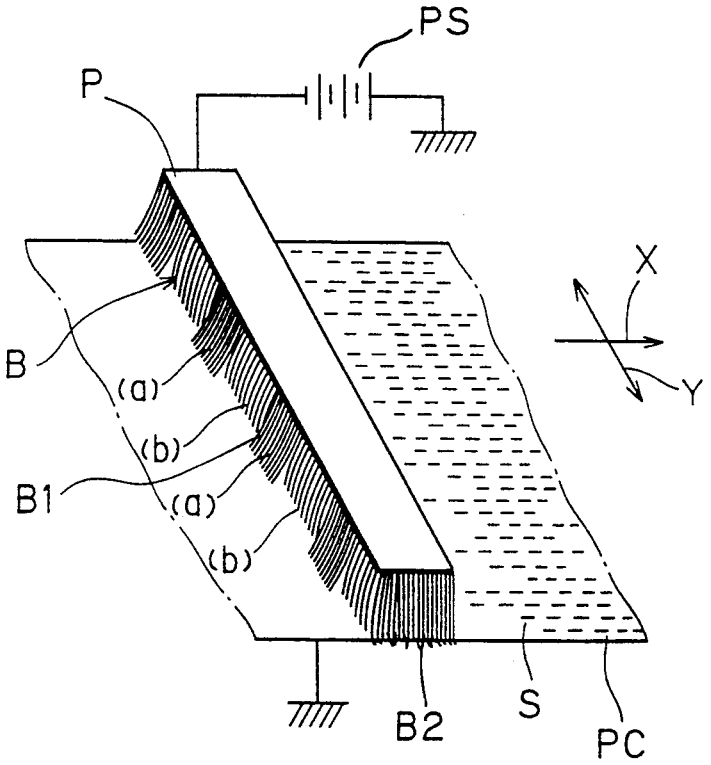
FIG. 2 (PRIOR ART)
FIG. 2 is a view for illustrating disarrangement of a charging brush in a charging device shown in FIG. 1.
Figure 3:
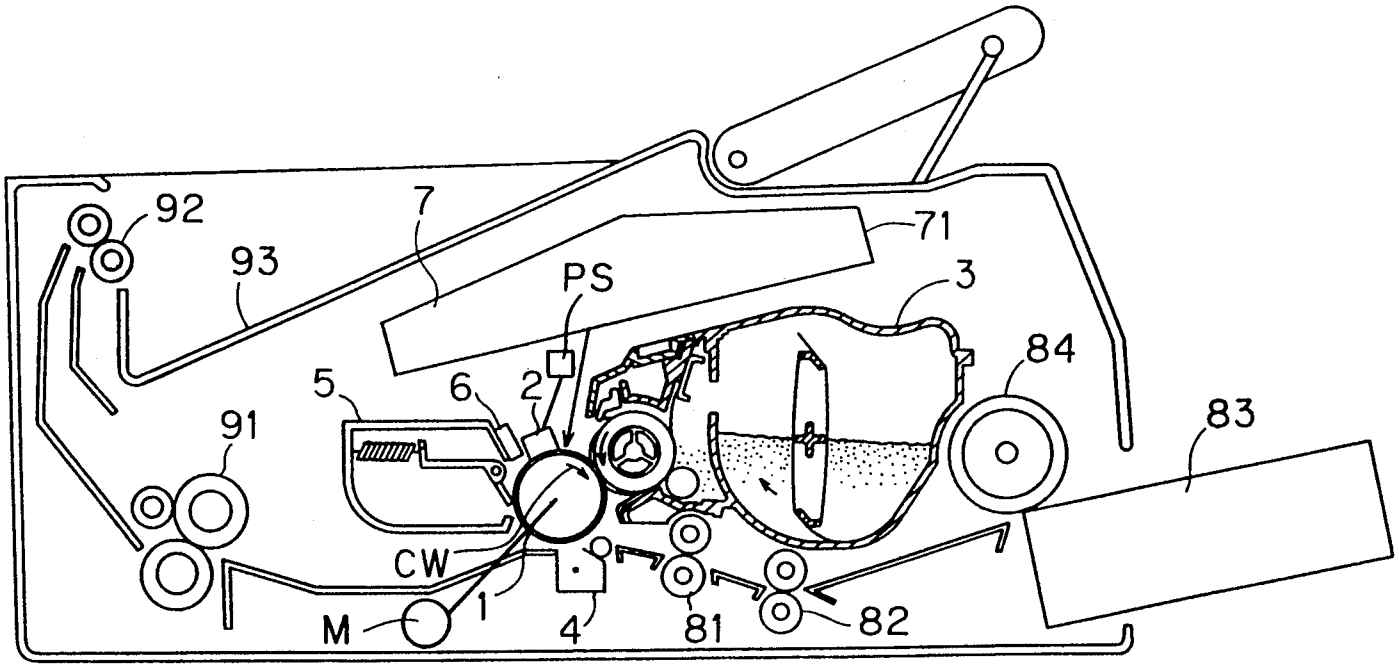
FIG. 3 is a schematic cross section of an example of a printer in which a charging device according to the invention is assembled.

All the following embodiments are assembled in a printer schematically shown in FIG. 3 for use. The printer in FIG. 3 will now be described below.

The printer shown in FIG. 3 is provided at its central portion with a photosensitive drum 1, i.e., an electrostatic latent image support member, which is driven to rotate by an electric motor M in a direction indicated by an arrow CW. Around the drum 1, there are disposed a brush charging device 2, developing device 3, a transfer charger 4, a cleaning device 5 and an eraser 6 which are aligned in this order. The charging device 2 is constructed according to the present invention, and receives an appropriate charging voltage from a power supply PS.

An optical system 7 is arranged above the photosensitive drum 1. The optical system has a housing 71 accommodating various components and devices such as a semiconductor laser device, polygon mirror, toroidal lens, half mirror, spheric mirror, return mirror and reflection mirror. The housing 71 is provided at its floor with an exposure slit. An image exposure is applied through the exposure slit and a space between the charging device 2 and the developing device 3 to the photosensitive drum 1.

At the right of the photosensitive drum 1 in the figure, there are sequentially disposed a timing roller pair 81, an intermediate roller pair 82 and a sheet feeder cassette 83, with which a sheet feed roller 84 confronts. At the left of the photosensitive drum 1 in the figure, there are sequentially disposed a fixing roller pair 91 and a sheet discharge roller pair 92, with which a sheet discharge tray 93 confronts.

In this printer, the surface of the photosensitive drum 1 is charged by the charging device 2 to have a charged area of a predetermined potential, which will be changed into an electrostatic latent image by an image exposure applied by the optical system 7. The electrostatic latent image thus formed is developed by the developing device 3 into a toner image, which moves to a transfer region confronting with the transfer charger 4.

Meanwhile, a transfer sheet of paper in a cutform is drawn from the feed cassette 83 by the feed roller 84. The sheet is moved through the intermediate roller pair 82 to the timing roller pair 81, from which the sheet is fed into the transfer region in synchronization with the toner image on the drum 1. In this manner, the toner image on the drum 1 is transferred onto the transfer sheet at the transfer region by the operation of the transfer charger 4. Then, the transfer sheet is fed to the fixing roller pair 91, at which the toner image is fixed. Then, the sheet is discharged into the discharge tray 93 by the discharge roller pair 92.

After the transfer of the toner image onto the transfer sheet, residual toner on the photosensitive drum 1 is cleaned up by the cleaning device 5, and residual charge is erased by light from a lamp of the eraser 6. A system speed of the printer, i.e., a peripheral speed of the photosensitive drum 1 is 3.5 cm/sec., and the developing device 3 is a contact developing device using one-component developer and carrying out reversal development.

The photosensitive drum 1 in this printer is an organic photosensitive member of a functionally separated type for negative charging, which has a sensitivity to long wave light. A manufacturing method of the same will be described below.

First, photosensitive liquid is prepared. This liquid is formed of $\tau$-type non-metal phthalocyanine at 1 weight part, polyvinyl butyral resin at 2 weight parts and tetrahydrofuran at 100 weight parts. This liquid is applied to a whole base surface of a cylindrical aluminium member by a dipping method, and then is dried to form a charge generating layer of 0.4 $\mu$m in thickness.

Then, following liquid is used. This liquid includes hydrazone compound at 8 weight parts, orange pigment at 0.1 weight part, polycarbonate resin at 10 weight parts which are dissolved into solvent of tetrahydrofuran at 180 weight parts. This liquid is applied to the charge generating layer by the dipping method, and then is dried to form a charge transmitting layer of 18 $\mu$m in thickness. In this manner, the photosensitive drum 1 is manufactured.

The charging device of the invention can be applied to various electrostatic latent image support members other than that described above.

There is no structural restriction, and the electrostatic latent image support member may be the photosensitive member of the functionally separated type described before or a photosensitive member of a single layer structure. Various known material other than those described before may be used for the charge generating material, charge transmitting material and others. That is; the charge generating material may be inorganic material such as zinc oxide, cadmium sulfide, selenium alloy and amolphous silicone, or material such as phthalocyanine and azo compound. The charge transmitting material may be formed of organic material such as hydrazone and styrene compound.

It is preferable to provide a surface protective layer on the outermost surface of the photosensitive member in order to suppress wear by the brush. This protective layer may be formed of resin such as ultraviolet setting resin, cold setting resin and thermosetting resin. It also may be formed of resin in which resistance adjusting agent is dispersed in the above resin. Further, it may be formed of a thin film which is prepared by vacuum deposition, ion plating or the like of metal oxide or metal sulfide. Moreover, it may be formed of amolphous carbon film which is formed by plasma-polymerized of gas containing hydrocarbon.

The base member may be formed of various conductive material, and also may be of a drum-shape, plate-shape or a belt-shape depending on the image forming system.

Toner used in the developing device 3 described before is of a negative chargeable type, and is manufactured from composition as follows. The composition is formed of polyester resin at 100 weight parts, carbon black MA#8 (manufactured by Mitsubishi Kasei Kogyo Kabushiki Kaisha) at 5 weight parts, Bontron S-34 (manufactured by Orient Kagaku Kogyo Kabushiki Kaisha) at 3 weight parts, and Viscorl TS-200 (Sanyo Kasei Kogyo Kabushiki Kaisha) at 2.5 weight parts. This composition is kneaded, ground and classified to manufacture toner particles having a mean diameter of 10 $\mu$m and a distribution, in which 80 weight percents are included in a range of the particle diameter from 7 $\mu$m to 13 $\mu$m. Hydrophobic silica (Tanolux 500 manufactured by Talco Co.) at 0.75 weight percents is added as fluidization agent to the toner particles, and mixed and agitated by a homogenizer.

The toner thus manufactured is accommodated in the developing device 3 for developing.

The brush charging device 2 in the printer will be described below.

Figure 4:
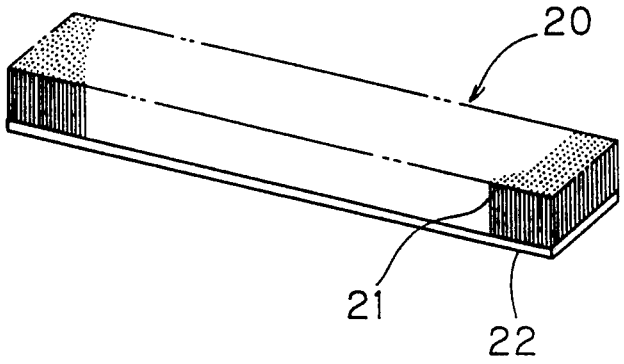
FIG. 4 is a perspective view of a typical example of a charging brush in a charging device.

The charging device according to the invention may have a charging brush 20 formed of a strip of pile cloth as shown in FIG. 4.

The pile cloth may formed as follows. Brush hairs 21 made of electrically conductive fiber of 3–10 deniers are woven into base cloth 22, of which rear surface is coated with conductive adhesive.

Figure 5:
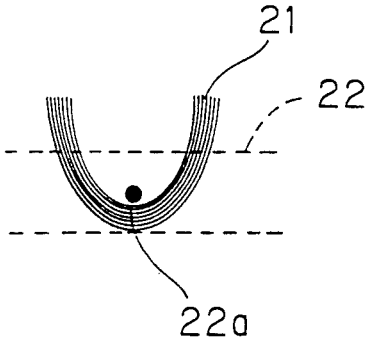
FIG. 5 is a view for illustrating an example of a structure for attaching brush hairs to a base cloth.
Figure 6:
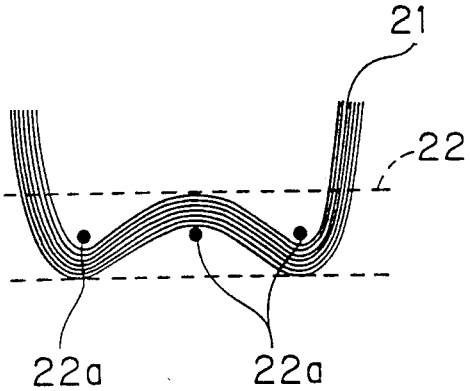
FIG. 6 is a view for illustrating another example of a structure for attaching brush hairs to a base cloth.

The brush hairs are grouped into bundles, each of which includes 50–100 hairs and are woven in a V-form with warps 22*a* of the base cloth 22, as shown in FIG. 5, or may be woven in a W-form as shown in FIG. 6.

The brush 20 is fixed to the back plate by the above adhesive.

The brush hairs may be formed of various material having an appropriate conductivity.

Such conductive material may be metal wires of tungsten, stainless steel, gold, platinum, iron, copper, aluminium and others.

Conductive resin material may be formed of fiber and resistance adjusting agent dispersed therein. The fiber may be formed of rayon, nylon, acetate, cuprammonium, vinylidene, vinylon, ethylene fluoride, promix, benzoate, polyurethane, polyester, polyethylene, polyvinyl chloride, polychlal, polynosic, polypropylene and others. The resistance adjusting agent may be carbon black, carbon fiber, metal powder, metal whiskers, metal oxide, semiconductor and others. In this case, a dispersed amount may be adjusted to obtain an intended resistance. Instead of dispersion in the fiber, the surface of the fiber may be covered with the resistance adjusting agent.

Then, specific embodiments of the charging device 2 according to the invention will be sequentially described below together with examples for comparison. Prior to this description, a method for evaluating a striped image noise will be described. This image noise is caused by irregular charging of the surface of the photosensitive drum by the charging device 2.

Figure 7:
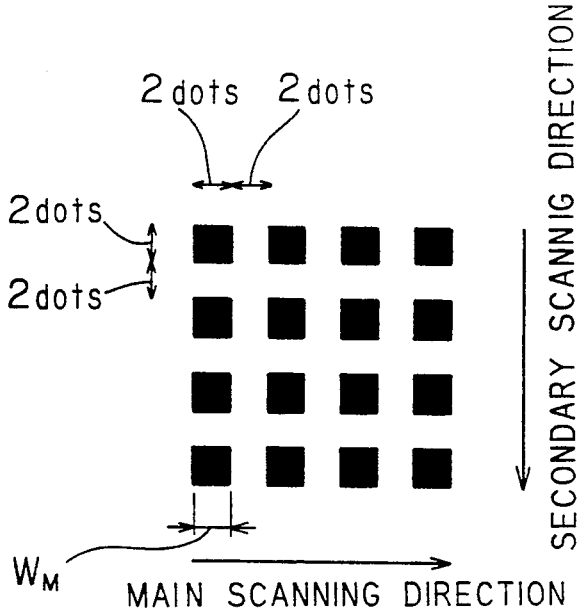
FIG. 7 is a view showing an example of a printed image for evaluating an image noise.

The evaluation of the image noise is performed as follows. The printer described before is used. After the charging by the charging device 2, repetitive patterns each including 2 dots of ON (turned-on) and 2 dots of OFF (turned off) are written in a main scanning direction by laser from the optical system 7, of which turning-on timing is preadjusted. Similar repetitive patterns each including 2 dots of ON (turned-on) and 2 dots of OFF (turned off) are written in a secondary scanning direction by the laser. Then, after the reversal development, transfer and fixing processes, a printed image shown in FIG. 7 is obtained.

It is assumed that this small black solid pattern of 2 dots by 2 dots on the printed image has a maximum width of $W_M$ in the main scanning direction. The width $W_M$ of the 30 small black solid patterns which are continuous in the main scanning direction has a standard deviation of $\sigma$. Depending on the standard deviation $\sigma$, following striped image noises are ranked.

| Standard Deviation $\sigma$ | Evaluation Mark |
|---|---|
| $0\ \mu m \leqq \sigma < 10\ \mu m$ | ◎ |
| $10\ \mu m \leqq \sigma < 20\ \mu m$ | ○ |
| $20\ \mu m \leqq \sigma < 40\ \mu m$ | Δ |
| $40\ \mu m \leqq \sigma$ | X |

Large values of the standard deviation $\sigma$ indicate the fact that the width of the small black solid pattern in the main scanning direction deviates to a large extent in the main scanning direction. In the printed dot patterns described before, the deviation $\sigma$ of 40 $\mu$m or more has been experientially recognized as an unpreferably strong noise. Therefore, the preferred value of $\sigma$ is lower than 40 $\mu$m, and more preferably is lower than 20 $\mu$m. The value of $\sigma$ lower than 10 $\mu$m is further preferable, in which case the striped noise cannot be recognized.

The double circular mark among the above image evaluating marks indicates a condition in which the striped image noise cannot be recognized, and the single circular mark indicates a condition, in which the noise is scarcely recognized. A triangular mark indicates a condition in which the image noise is practically allowable, and the mark "X" indicates a condition in which the image noise is not practically allowed.

Then, embodiments and examples for comparison will be described.

EMBODIMENT 1

The brush hairs are formed of rayon fiber of 6 deniers, which has an electrical resistivity of about $1\times10^5$ Ω.cm and contains conductive carbon powder at 12 wt.% with respect to the whole weight.

Figure 8:
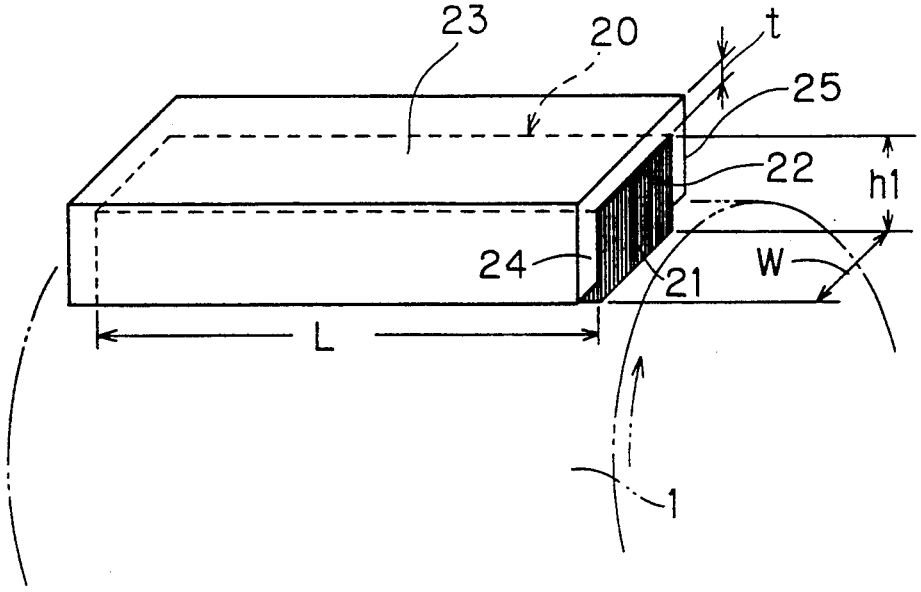
FIG. 8 is a perspective view of an embodiment 1.
Figure 9:
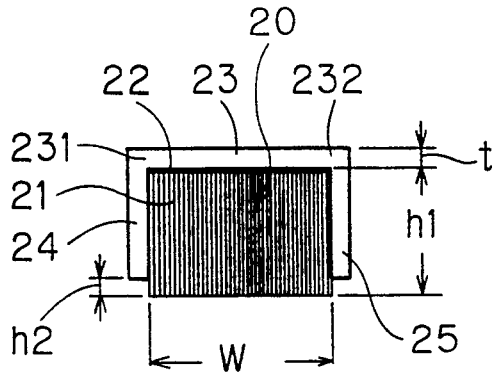
FIG. 9 is a side view of an embodiment shown in FIG. 8.

As shown in FIGS. 8 and 9, the fiber 21 is woven in a W-form into the base cloth 22 having a thickness of 0.5 mm, as shown in FIG. 6, to form the charging brush 20, which has a length L of 230 mm in a widthwise direction of the photosensitive drum, a width W of 9 mm, a height h1 of 7 mm, and a fiber density of 15000 pcs (hairs)/cm$^2$ in a central portion. The rear surface of the base cloth 22 is coated with electrically conductive adhesive, by which the base cloth 22 is fixed to a back plate 23 of aluminium having a thickness t of 1 mm.

The back plate 23 is integrally provided at its upstream end 231 and downstream end 232, in a moving direction of the surface of the photosensitive drum 1, with an upstream support plate 24 and a downstream support plate 25, which are perpendicular to the back plate 23. Each support plate is made from aluminium, and has a thickness of 1 mm and the same length as the back plate 23 in the axial direction of the photosensitive drum.

The upstream and downstream support plates 24 and 25 have the same heights, and have free ends beyond which the brush hairs 21 project through a length h2 of 1 mm.

Also in the embodiments 2–6 and 8 described later, each support plate has a thickness of 1 mm and, in the embodiments 2–8, a free end beyond which the brush hairs project through a length h2 of 1 mm.

The appropriate value of the brush projection length h2 depends on several factors such as material of the brush hairs. However, with the length from about 0.3 mm to about 2.5 mm, disarrangement of the brush is suppressed, and a discharging efficiency is improved.

The back plate 23 corresponding to the holder member described before may be formed of metal such as aluminium, stainless steel, iron, copper and brass, other than aluminium. Also, it may be formed of electrically conductive resin, or paper immersed with conductive material. Further, it may be a plate, e.g., of glass or insulating resin having a conductive surface. If a transparent plate (e.g., a glass plate provided at its surface with translucent spattering film of ITO) is employed, it can be used in a special system in which exposure is carried out from a back side of the holder member simultaneously with the charging.

The support plates 24 and 25 or the like corresponding to the brush restricting or supporting means described before also may be formed of metal such as stainless steel, iron, copper or brass, other than aluminium. They also may be formed of resin such as polyethylene, polypropylene, polyvinyl alcohol, polyvinyl acetate, ethylene vinyl acetate copolymer, poly methyl methacrylate, polycarbonate, polystyrene, acrylonitrile acrylic acid copolymer, acrylonitrile butadiene styrene copolymer, poly ethylene terephthalic acid, polyurethane elastomer, viscose rayon, cellulose nitrate, cellulose acetate, cellulose triacetate, cellulose propionate acid, cellulose acetate butyrate, ethyl cellulose, regenerated cellulose, nylon 6, nylon 66, nylon 11, nylon 12, nylon 46, polyimide, polysulfone, polyether sulfone, polyvinyl chloride, vinyl chloride vinyl acetate copolymer, polyvinylidene chloride, vinylidene chloride vinyl chloride copolymer, vinyl nitrile rubber alloy, polytetrafluoroethylene, polychlorofluoroethylene, polyvinyl fluoride, or polyvinylidene fluoride. In view of damage against the electrostatic latent image support member caused by the contact, soft material or member may be used.

EMBODIMENT 2

Figure 10:
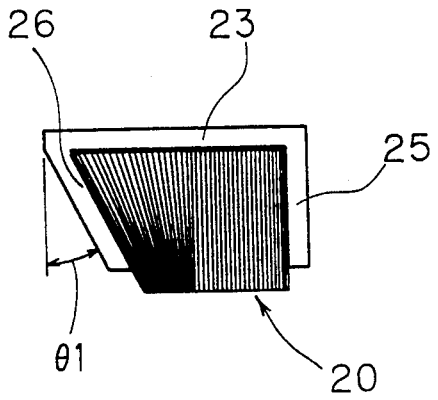
FIG. 10 is a side view of an embodiment 2.

As shown in FIG. 10, the embodiment 2 employs a support plate 26 instead of the upstream support plate 24 in the embodiment 1. The upstream support plate 26 is inclined at an angle $\theta 1$ of 30 degrees with respect to a direction perpendicular to the back plate 23. This converges the end of the brush and thus further suppresses the disarrangement.

EMBODIMENT 3

Figure 11:
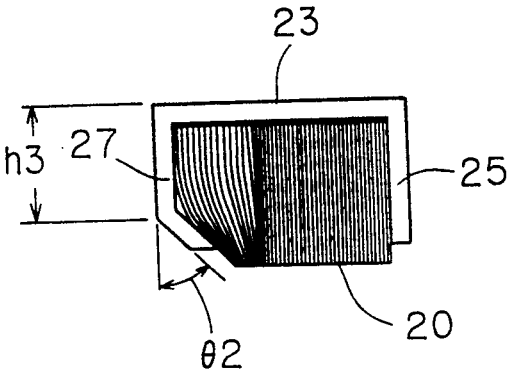
FIG. 11 is a side view of an embodiment 3.

As shown in FIG. 11, the embodiment 3 employs a support plate 27 instead of the upstream support plate 24 in the embodiment 1. The support plate 27 is perpendicularly projected from the back plate 23 through a height h3 of 4 mm, and then is inclined toward the brush 20 at an angle $\theta 2$ of 45 degrees with respect to the direction perpendicular to the back plate 23.

EMBODIMENT 4

Figure 12:
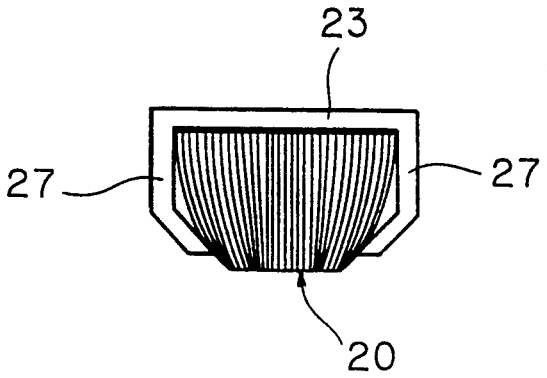
FIG. 12 is a side view of an embodiment 4.

As shown in FIG. 12, the embodiment 4 employs a pair of laterally symmetrical support plates 27 corresponding to that in the embodiment 3, instead of the upstream and downstream support plates 24 and 25 in the embodiment 1.

EMBODIMENT 5

Figure 13:
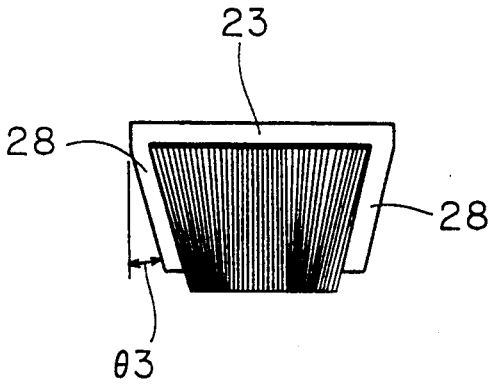
FIG. 13 is a side view of an embodiment 5.

As shown in FIG. 13, the embodiment 5 employs a pair of laterally symmetrical support plates 28, instead of the upstream and downstream support plates 24 and 25 in the embodiment 1. Each support plate 28 is inclined toward the brush 20 at an angle $\theta 3$ of 15 degrees from the direction perpendicular to the back plate 23.

EMBODIMENT 6

Figure 14:
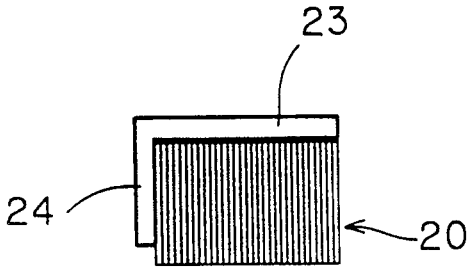
FIG. 14 is a side view of an embodiment 6.

As shown in FIG. 14, the downstream support plate 25 in the embodiment 1 is eliminated in the embodiment 6.

EXAMPLE 1 FOR COMPARISON

In this example, the upstream and downstream support plates 24 and 25 in the embodiment 1 are eliminated.

EXAMPLE 2 FOR COMPARISON

In this example, the upstream support plates 24 in the embodiment 1 is eliminated.

The embodiments 1-6 and the examples 1 and 2 were respectively assembled in the printer shown in FIG. 3. A direct current voltage of about −1.1 KV was applied from the power supply PS through the back plate 23 of aluminium for charging the surface of the photosensitive drum 1 to have a mean potential of about −750 V. Then, repetitive patterns were written, as shown in FIG. 7, by the laser and the patterns were developed to toner images by the device 3 with a developing bias of −300 V. The images were printed out. The image noises (striped noises) were evaluated in the manner described before in the initial printing operation and after the printing of 5000 sheets. The obtained results are shown in following Table 1.

TABLE 1

| | Image Evaluation | |
|---|---|---|
| | Initial ($\sigma$) | After 5000 sheets ($\sigma$) |
| Embodiment 1 | ◎ (5 μm) | ○ (15 μm) |
| Embodiment 2 | ◎ (5 μm) | ○ (13 μm) |
| Embodiment 3 | ◎ (5 μm) | ○ (12 μm) |
| Embodiment 4 | ◎ (5 μm) | ◎ (8 μm) |
| Embodiment 5 | ◎ (5 μm) | ◎ (9 μm) |
| Embodiment 6 | ◎ (5 μm) | Δ (38 μm) |
| Example 1 | ◎ (5 μm) | X (80 μm) |
| Example 2 | ◎ (5 μm) | X (75 μm) |

As can be seen from Table 1, the embodiments 1-6 can remarkably improve the striped image noises even after the printing of 5000 sheets, as compared with the examples 1 and 2 for comparison having no upstream support plate. The reason can be considered as follows. In the embodiments 1-6, the upstream support plates 24, 26, 27 and 28 support and align the upstream end, in the moving direction of the surface of the photosensitive drum, of the charging brush 20 to prevent the disarrangement thereof.

EMBODIMENT 7

Figure 15:
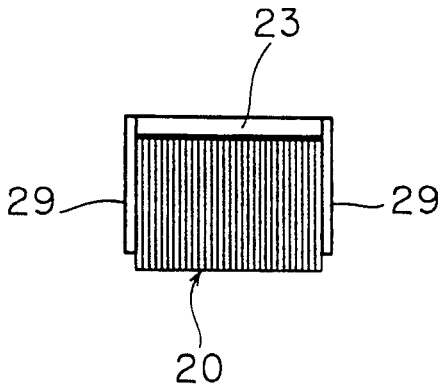
FIG. 15 is a side view of an embodiment 7.

As shown in FIG. 15, the upstream and downstream support plates 24 and 25 in the embodiment 1 are replaced with polyethylene films 29 each having a thickness of 0.3 mm and adhered to the back plate 23 by epoxy adhesive.

This charging device was assembled in the printer shown in FIG. 3. A direct current voltage of about −1.1 KV was applied through the back plate 23 of aluminium for charging the surface of the photosensitive drum 1 to have a mean potential of about −750 V. Image of repetitive patterns was written and developed to a toner image with the developing bias of −300 V. The toner image was printed out. As shown in Table 2, a problem relating to the striped image noise was not generated even after the printing of 5000 sheets.

TABLE 2

| | Image Evaluation | |
|---|---|---|
| | Initial ($\sigma$) | After 5000 sheets ($\sigma$) |
| Embodiment 7 | ◎ (5 μm) | ○ (19 μm) |

Since the support plate 29 in this embodiment is made from soft material, the effect of improving the image noise is slightly inferior to that of the charging device in the embodiment 1, but is sufficiently superior to that of the examples 1 and 2, as can be seen from Table 2.

It has been found that this embodiment including the support plate 29 made from the soft material is especially advantageous with respect to damage against the photosensitive drum 1.

That is; the maximum roughness of the surface of the photosensitive drum was initially about 0.05 μm, and was 0.14 μm after the printing of 50000 sheets. Meanwhile, the roughness after the printing of 5000 sheets was 0.27 μm in the embodiment 1.

As described above, it can be understood that the damage against the surface of the photosensitive drum is remarkably reduced in this embodiment because the support plate 29 is made from the soft material.

EMBODIMENT 8

Figure 16:
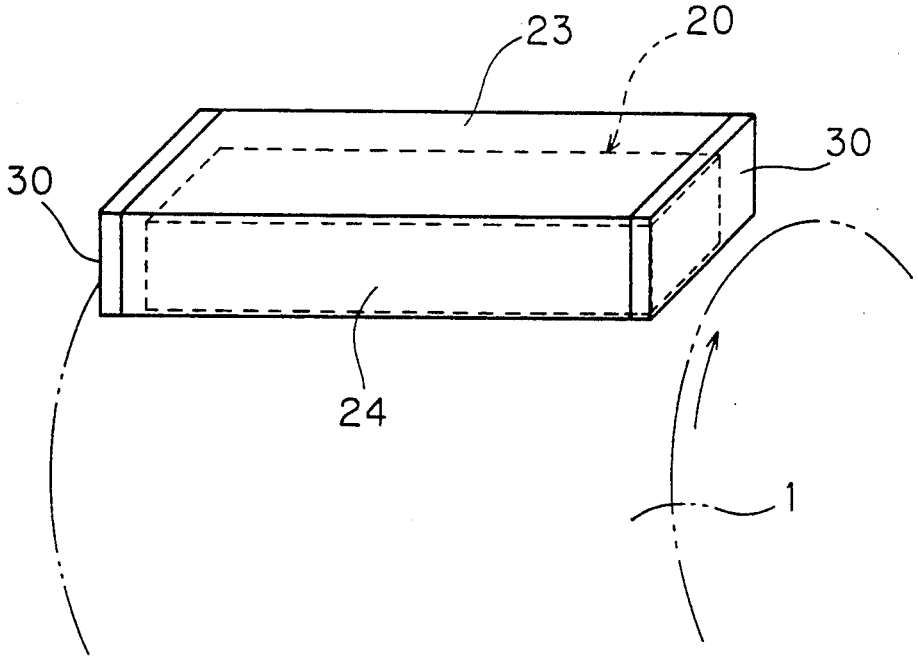
FIG. 16 is a perspective view of an embodiment 8.

The charging brush 20 corresponding to that of the charging device in the embodiment 1 has the length L of 212 mm in the axial direction of the photosensitive drum, which is nearly equal to the width (210 mm) of the transfer sheet of paper. As shown in FIG. 16, the charging brush 20 is provided at it opposite end portions, in the axial direction of the photosensitive drum, with side end support plates 30 made from aluminium and projected perpendicularly from the back plate 23. The result is shown in Table 3.

TABLE 3

| | Image Evaluation | |
|---|---|---|
| | Initial ($\sigma$) | After 5000 sheets ($\sigma$) |
| Embodiment 7 | ⊚ (5 μm) | ○ (15 μm) |

EMBODIMENT 9

The brush hairs are formed of rayon fiber of 5 deniers, which has an electrical resistivity of about $1\times10^5$ Ω.cm and contains conductive carbon powder at 12 wt.% with respect to the whole weight.

Figure 17:
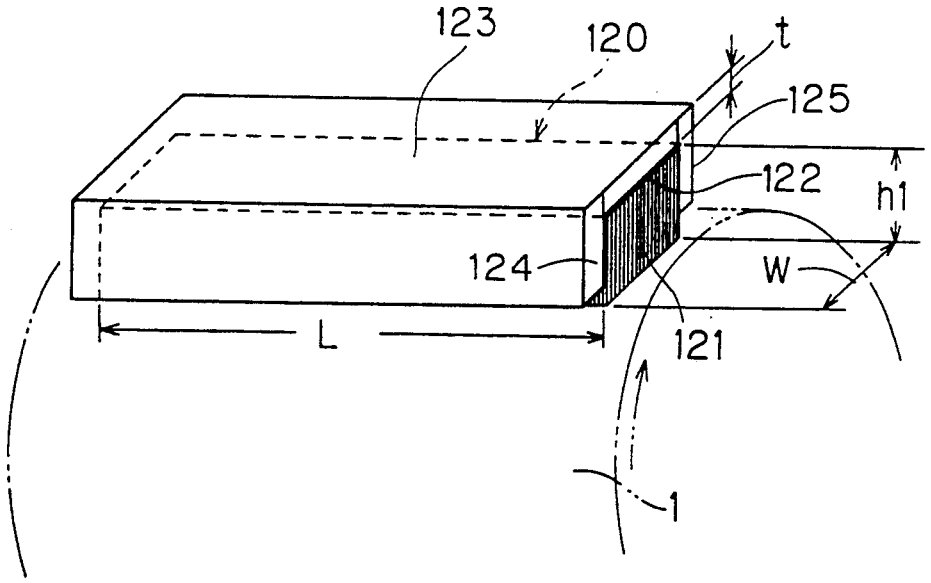
FIG. 17 is a perspective view of an embodiment 9.
Figure 18:
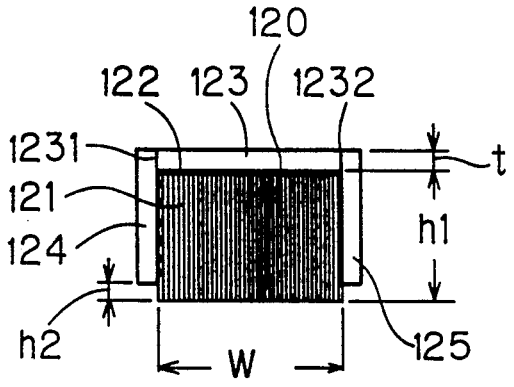
FIG. 18 is a side view of an embodiment in FIG. 17.

As shown in FIGS. 17 and 18, this fiber 121 is woven in a W-form into a base cloth 122 having a thickness of 0.5 mm, as shown in FIG. 6, to form a charging brush 120, which has a length L of 230 mm in a widthwise direction of the photosensitive drum, a width W of 9 mm, a height h1 of 7 mm, and a fiber density of 15000 pcs (hairs)/cm$^2$ in a central portion. The rear surface of the base cloth 122 is coated with electrically conductive adhesive, by which the base cloth 122 is fixed to a back plate 123 of aluminium having a thickness t of 1 mm.

The back plate 123 is provided at its upstream end 1231 and downstream end 1232, in a moving direction of the surface of the photosensitive drum 1, with an upstream support plate 124 and a downstream support plate 125, which are perpendicular to the plate 123. Each support plate is made from aluminium, and has a thickness of 1 mm and the same length as the back plate 123 in the axial direction of the photosensitive drum.

The upstream and downstream support plates 124 and 125 have the same heights, and have free ends beyond which the brush hairs 121 project through a length h2 of 1 mm.

Also in the embodiments 10–12, 16 and 17 described later, each support plate has a thickness of 1 mm and a free end beyond which the brush hairs project through a length h2 of 1 mm.

Figure 19:
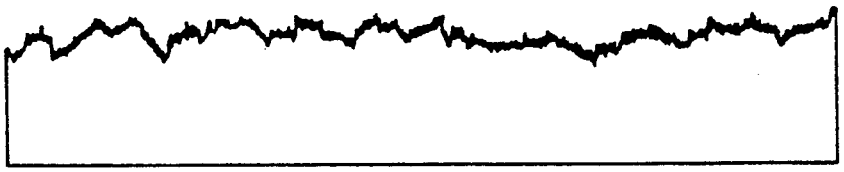
FIG. 19 is a fragmentary enlarged view illustrating unevenness of an inner surface of a support plate in an embodiment in FIG. 17.

Unevenness is formed on the inner surfaces of the support plates 124 and 125 by sand blast. FIG. 19 is a fragmentary enlarged view showing the unevenness formed on the inner surface by the sand blast. The maximum surface roughness $R_{max}$ of the surface is 2.0 μm. This surface roughness was determined by measuring the maximum height ($R_{max}$) with a surface roughness tester (Surfcom 550A manufactured by Tokyo Seimitsu Corp.) in accordance with "JIS-B-0601-1970". Surface roughness in the later descriptions was determined in the similar manner. The roughness on the inner surfaces of the support members is required to be formed to an extent capable of preventing the disarrangement of the brush hairs, and generally, is preferably in a range of $R_{max}$ from 2.0 μm to 40 μm in view of the brush hairs which are ordinarily used.

The support plates may be formed of metal such as iron, nickel and phosphor bronze, other than aluminium in the embodiment. The roughness on the inner surfaces of the support plates may be formed, for example, by machining with a cutting tool, etching or embossing, other than the sand blast in the embodiment. The roughness also may be formed of many grooves extending along a direction in which the brush hairs are attached.

EMBODIMENT 10

Figure 20:
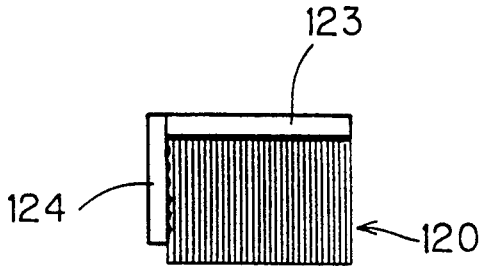
FIG. 20 is a side view of an embodiment 10.

As shown in FIG. 20, the downstream support plate 125 in the embodiment 9 is eliminated in this embodiment, and the inner surface of the upstream support plate 124 has the maximum roughness of 40 μm.

EMBODIMENT 11

Support plates correspond to the support plates 124 and 125 in the embodiment 9, and have the maximum surface roughness of 10 μm.

EMBODIMENT 12

Support plates correspond to the support plates 124 and 125 in the embodiment 9, and have the maximum surface roughness of 40 μm.

EMBODIMENT 13

Figure 21:
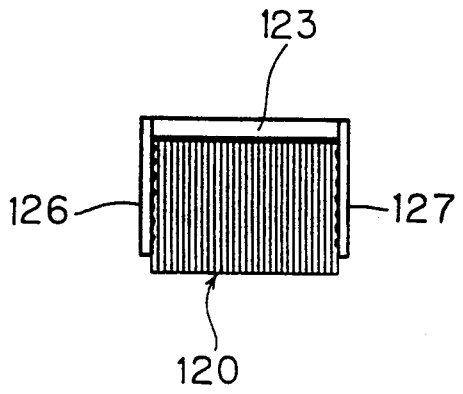
FIG. 21 is a side view of an embodiment 13.

As shown in FIG. 21, polyethylene films 126 and 127 each having a thickness of 0.3 mm and an embossed inner surface are employed instead of the support plates 124 and 125 in the embodiment 9. The inner surface of each support plate has a maximum roughness of 2.0 μm. Each support plate has a free end beyond which the hairs project through a length of 1 mm.

As can be seen from the above, the support plates may be made from resin, as already described with respect to the embodiment 1. In addition to the polyethylene, they may be made from material such as polyester and polycarbonate. In this case, the roughness on the inner surfaces may be formed by various kinds of surface treatment as described in connection with the embodiment 1. However, the embossing employed in this embodiment facilitates the formation of the uniform unevenness on the surface of the resin members.

EMBODIMENT 14

The inner surface of each support plate corresponding to that in the embodiment 13 has the roughness of 20 μm.

EMBODIMENT 15

The inner surface of each support plate corresponding to that in the embodiment 13 has the roughness of 40 μm.

EMBODIMENT 16

The inner surfaces of the support plates corresponding to the upstream and downstream support plates 124 and 125 in the embodiment 9 have the maximum surface roughness of 0.02 μm.

EMBODIMENT 17

The inner surface of the support plate corresponding to the upstream support plate 124 in the embodiment 10 has the maximum surface roughness of 0.02 μm.

EMBODIMENT 18

The inner surfaces of the support plates corresponding to the upstream and downstream support plates 126 and 127 in the embodiment 13 have the maximum surface roughness of 0.01 μm.

The embodiments 9–18 were respectively assembled in the printer shown in FIG. 3. A direct current voltage of about −1.1 KV was applied through the back plate 123 of aluminium for charging the surface of the photosensitive drum 1 to have a mean potential of about −750 V. Images of repetitive patterns were written by the laser and developed to toner images with a developing bias of −300 V. The toner images were printed out. The image noises (striped noises) were evaluated in the manner described before in the initial printing operation and after the printing of 5000 sheets. The obtained results are shown in Table 4.

TABLE 4

| | Rmax μm | Image Evaluation Initial (σ) | After 5000 sheets (σ) |
|---|---|---|---|
| Embodiment 9 | 2.0 μm | ◎ (5 μm) | ◎ (9 μm) |
| Embodiment 10 | 40 μm | ◎ (5 μm) | ◎ (9 μm) |
| Embodiment 11 | 10 μm | ◎ (5 μm) | ◎ (7 μm) |
| Embodiment 12 | 40 μm | ◎ (5 μm) | ◎ (8 μm) |
| Embodiment 13 | 2.0 μm | ◎ (5 μm) | ◎ (9 μm) |
| Embodiment 14 | 20 μm | ◎ (5 μm) | ◎ (7 μm) |
| Embodiment 15 | 40 μm | ◎ (5 μm) | ◎ (7 μm) |
| Embodiment 16 | 0.02 μm | ◎ (5 μm) | ○ (15 μm) |
| Embodiment 17 | 0.02 μm | ◎ (5 μm) | ○ (38 μm) |
| Embodiment 18 | 0.01 μm | ◎ (5 μm) | ○ (19 μm) |

As can be seen from Table 4, the embodiments 9–15 improve the striped image noises not only in the initial printing operation but also after the printing of 5000 sheets, as compared with the embodiments 16–18. The reason can be considered as follows. The embodiments 9–15 include the upstream support plates, and the inner surfaces thereof are provided with the unevenness having the maximum surface roughness $R_{max}$ of 2–40 μm according to the standard JIS-B-0601-1970. Therefore, the upstream ends of the charging brushes 20 in the moving direction of the surface of the photosensitive drum are aligned, and the disarrangement both in the above moving direction and the direction crossing the same are prevented.

It can be contemplated to provide side end support members which align the opposite ends of the charging brush, in the direction crossing the moving direction of the surface of the electrostatic latent image support member, to prevent the disarrangement thereof. In this case, the side end support members may have inner surfaces provided with the unevenness for preventing the disarrangement and grouping, similarly to the inner surfaces of the support members described before.

EMBODIMENT 19

Figure 22:
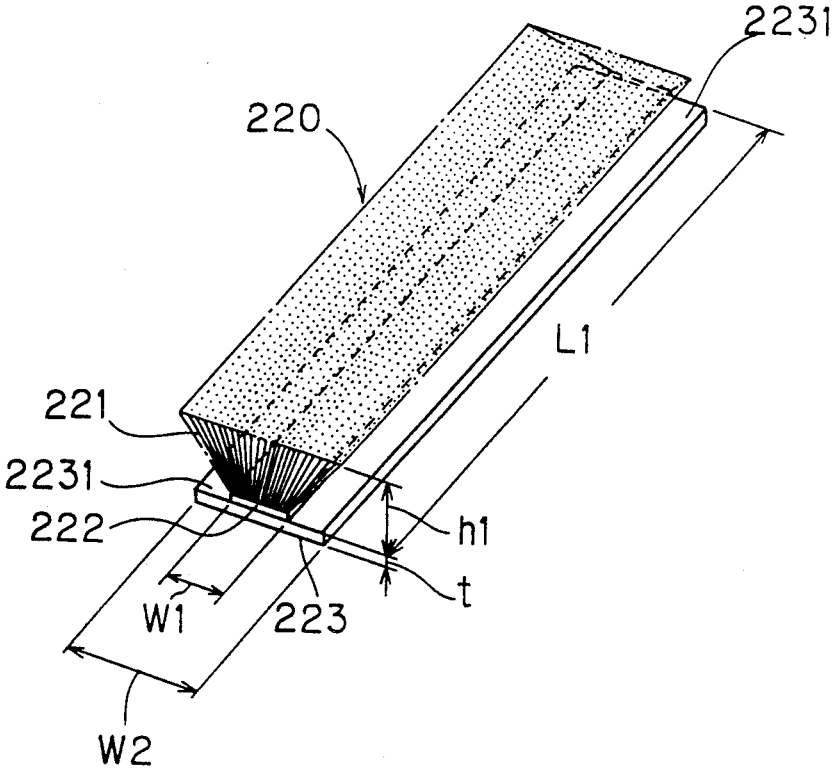
FIG. 22 is a perspective view of a charging brush and a back plate supporting the same in an embodiment 19.
Figure 23A:
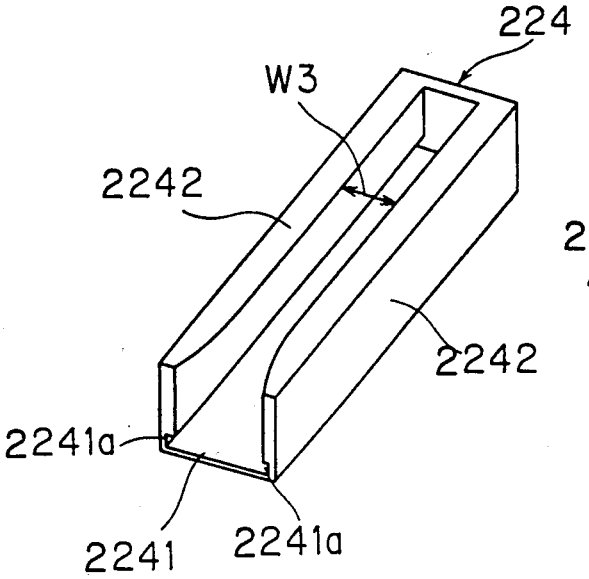
FIG. 23A is a perspective view of a guide rail to which a charging brush in FIG. 22 is attached.
Figure 23B:
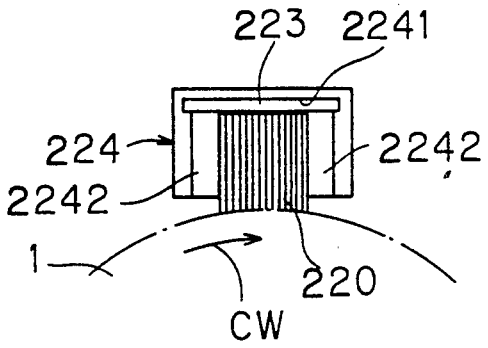
FIG. 23B is a side view showing, a working condition in which a brush in FIG. 22 is attached to the rail.

This brush charging device includes a charging brush 220 shown in FIG. 22 and a guide rail 224 shown in FIGS. 23A and 23B. The guide rail 224 is arranged in the main body o the printer shown in FIG. 3.

The brush hairs of the charging brush 220 are formed of rayon fiber of 7 deniers, which has an electrical resistivity of about $1\times10^5$ Ω.cm and contains conductive carbon powder at 12 wt.% with respect to the whole weight.

As shown in FIG. 22, bundles of this fiber 221, each including 50 hairs, are woven in a W-form into a base cloth 222 having a thickness of 0.5 mm, as shown in FIG. 6, to form the charging brush 220. The brush 220 has a length L1 of 230 mm in a widthwise direction of the photosensitive drum, a width W1 of 9 mm, a height h1 of 7 mm, and a fiber density of 15000 pcs (hairs)/cm$^2$ in a central portion. The rear surface of the base cloth 222 is coated with electrically conductive adhesive, by which the base cloth 222 is fixed to a back plate 223 of aluminium having a thickness t of 1 mm. The plate 223 has a length similar to the length L1 of the brush and a width W2 of 13 mm, and projects in the opposite directions beyond the brush through 2 mm at each side.

The guide rail 224 is fixedly disposed above the photosensitive drum 1 of the printer, and includes a mounting portion 2241, to which the back plate 223 supporting the charging brush is removably attached, and a pair of brush end support portions 2242 extending from the mounting portion 2241. Both the mounting portion 2241 and the support portions 2242 extend along a rotation axis (widthwise direction) of the photosensitive drum 1. The mounting portion 2241 has a groove **2241*a* to which opposite projections 2231 of the back plate 223 are removably inserted. Although the paired support portions 2242 are spaced through a length W3 nearly equal to the width W1 of the brush, they are diverged toward an open end to facilitate insertion of the brush 220** and are closed at the other end.

Before the charging device thus constructed is used, the charging brush 220 is located and stored outside the guide rail 224 so that the brush is not subjected to an unnecessary external force, which may cause disadvantages such as deformation and solidification due to accumulation of the stress and creep. When used, as shown in FIG. 23B, the back plate 223 is inserted into the mounting portion 2241, and the brush 220 is attached to the guide rail by inserting the same between the support portions 2242.

The brush 220 thus mounted intimately contacts the surface of the drum 1, and is aligned and supported in the widthwise direction of the drum 1 at the upstream brush end, in the rotating direction CW of the drum 1, by the support portion 2242 contacting this brush end. Thereby, the surface of the drum 1 is uniformly charged. Also the downstream brush end in the rotating direction CW of the drum 1 is aligned and supported in the widthwise direction of the drum 1 by the support portion 2242, whereby smear of this brush end is prevented, and uniform charging is promoted.

EMBODIMENT 20

Figure 24:
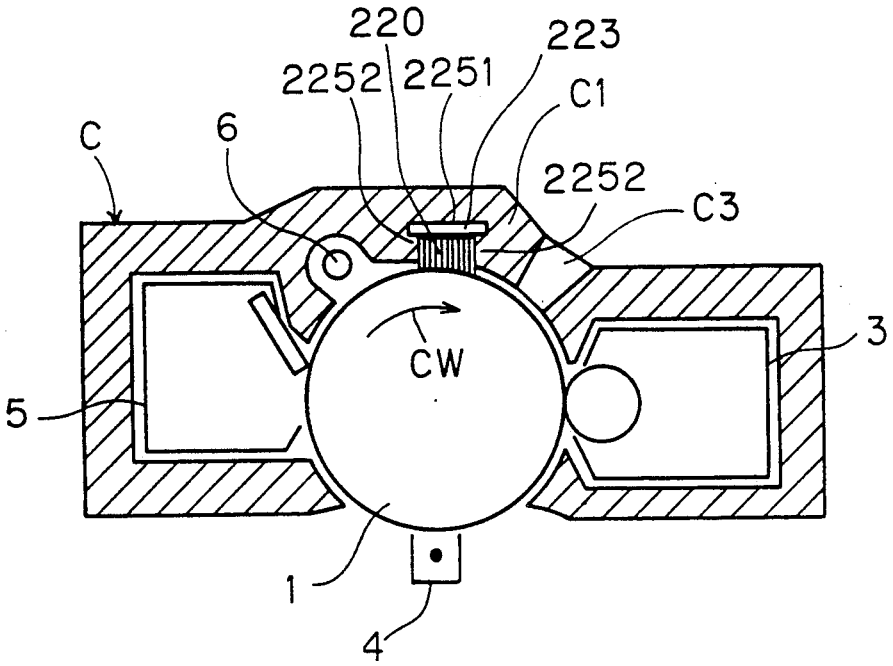
FIG. 24 is a cross section of an embodiment 20.

This charging device is removably attached to an imaging cartridge (process cartridge) C schematically shown in FIG. 24. The imaging cartridge C is formed of an integrated assembly of the photosensitive drum 1, developing device 3, cleaning device 5 and eraser 6 which are provided in the printer shown in FIG. 3, and is removably attached to the main body of the printer. The charging device is formed of a part C1 of a casing of the cartridge C, the charging brush 220 in the embodiment 19 and the back plate 223 supporting the brush.

Figure 25:
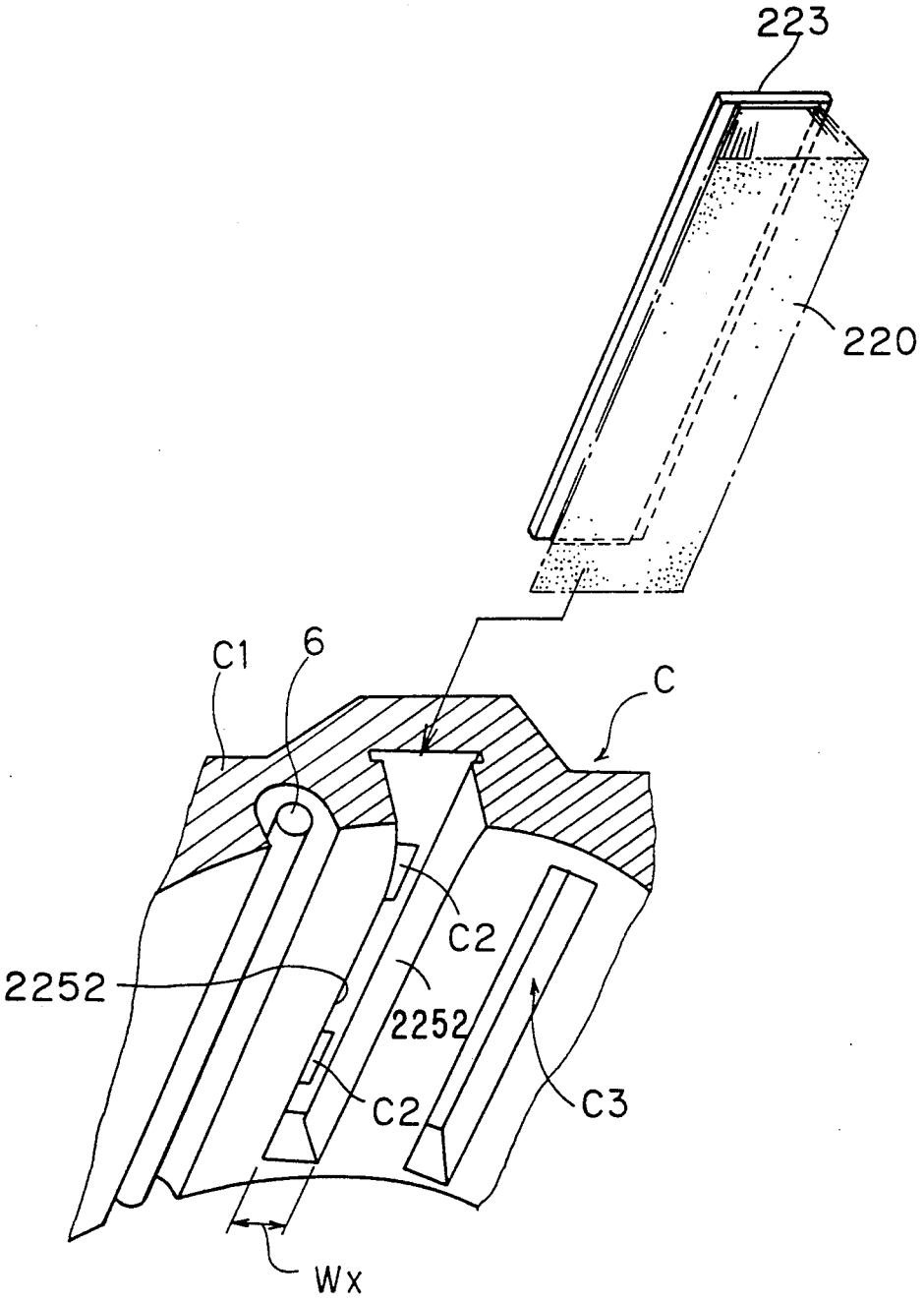
FIG. 25 is a fragmentary exploded perspective view of an embodiment in FIG. 24.

The casing portion C1 is provided with a mounting portion 2251, to which the back plate 223 is removably attached, and a pair of brush end support portions 2252 extending from the mounting portion 2251. Although the paired support portions 2252 are spaced through a length Wx nearly equal to the width W1 of the brush, they are diverged toward an open end to facilitate insertion of the brush 220, as shown in FIG. 25, and are closed at the other end. At C3 is indicated a slit through which the image exposure is performed by the optical system 7 when the cartridge C is mounted to the printer.

According to this charging device, the charging brush 220 is not attached to the printer before it is used. When it is used, the back plate 223 is inserted into the mounting portion 2251, and the brush 220 is inserted between the support portions 2252 for mounting the brush 220 in the casing C.

The brush 220 thus mounted contacts the surface of the drum 1. The upstream brush end is aligned and supported in the widthwise direction of the drum 1 by the support portion 2252 contacting the brush end, and the downstream brush end is also aligned and supported in the widthwise direction of the drum by the support portion 2252 contacting the brush end.

In FIG. 25, at C2 is indicated contact points, which contact the back plate 223 for receiving an electrical power for discharging from the power supply PS when the brush 220 is mounted.

EMBODIMENT 21

Figure 26A:
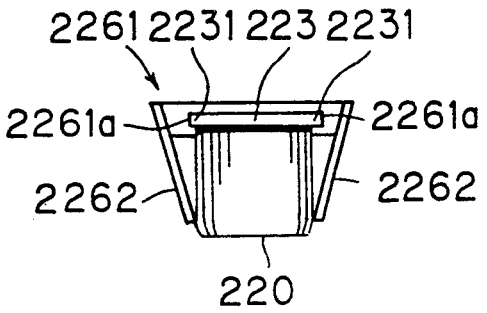
FIG. 26A is a side view of an embodiment 21.
Figure 26B:
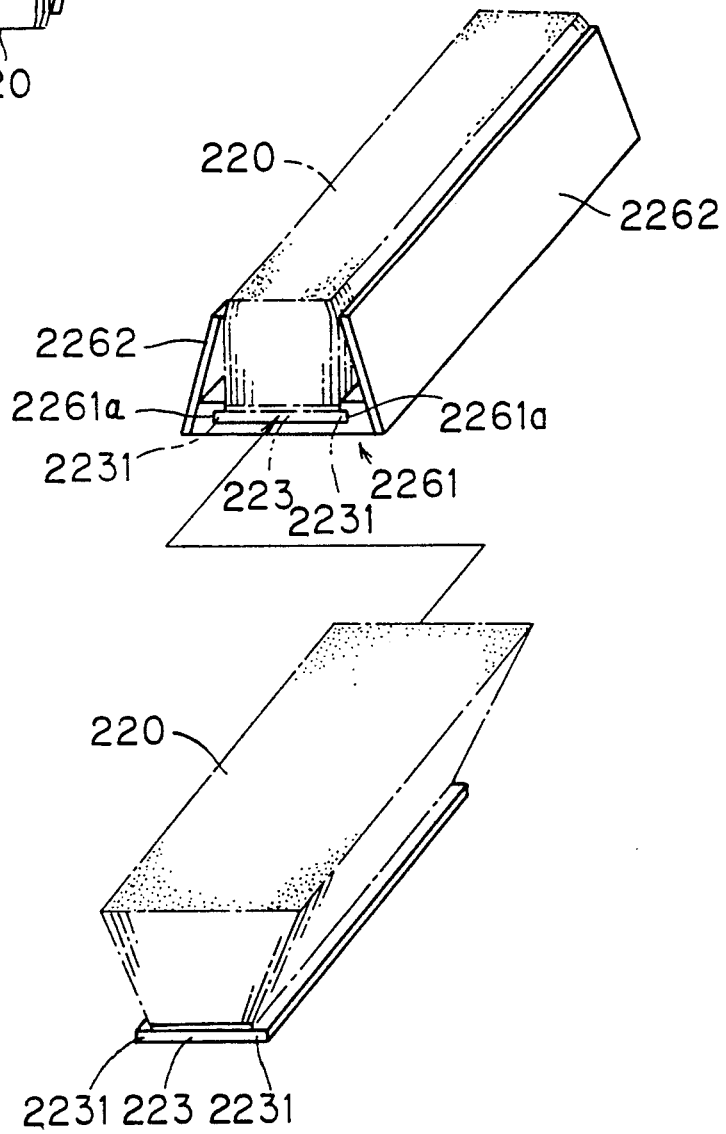
FIG. 26B is an exploded perspective view of the same.

The charging device is formed of the charging brush 220 and the back plate 223 in the embodiment 19, as well as a back plate mounting member 2261 shown in FIGS. 26A and 26B and a pair of brush end support plates 2262 fixed to and extending from inclined end surfaces at the upstream and downstream sides of the mounting member 2261. The mounting member 2261 is fixedly disposed above the photosensitive drum 1 of the printer, and is provided with grooves 2261*a* to which opposite projections 2231 of the back plate 223 can be removably inserted. The paired support plates 2262 are inclined and converged toward the photosensitive drum 1.

Before the charging device thus constructed is used, the charging brush 220 is located outside the mounting member 2261. When used, the back plate 223 is inserted into the mounting member 2261, and the brush 220 is inserted between the support plates 2262. The brush 220 thus mounted contacts the surface of the drum 1. The upstream brush end is pushed inwardly by the support portion 2262 contacting it to be aligned and supported in the widthwise direction of the drum 1, and the downstream brush end is also pushed inwardly by the support portion 2262 contacting it to be aligned and supported in the widthwise direction of the drum 1.

EMBODIMENT 22

Figure 27A:
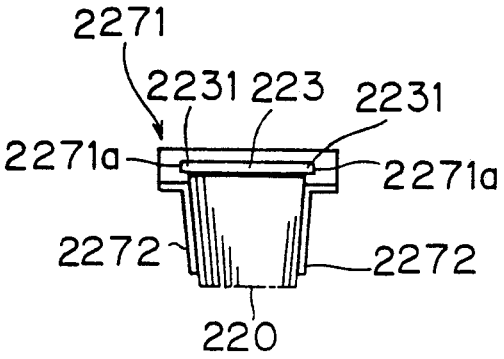
FIG. 27A is a side view of an embodiment 22.
Figure 27B:
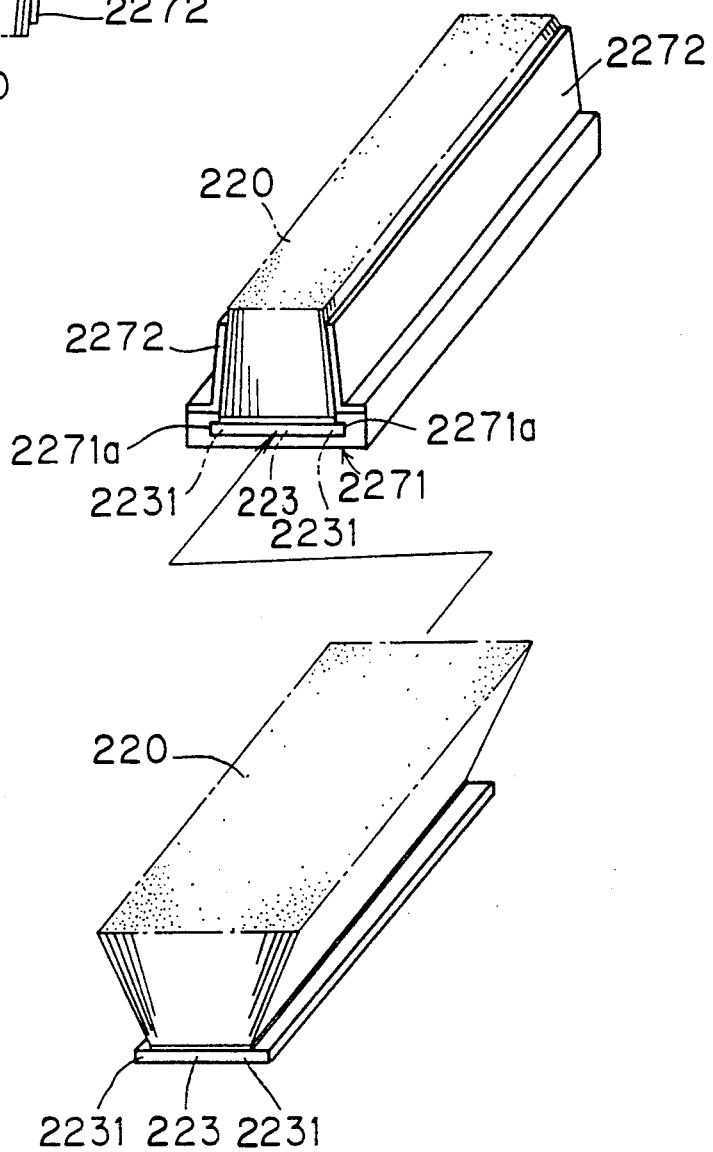
FIG. 27B is an exploded perspective view of the same.

The charging device is formed of the charging brush 220 and the back plate 223 in the embodiment 19, as well as a back plate mounting member 2271 shown in FIGS. 27A and 27B and a pair of brush end support plates 2272 fixed to and extending from lower surfaces at the upstream and downstream sides of the mounting member 2271. The mounting member 2271 is fixedly disposed above the photosensitive drum 1 of the printer, and is provided with grooves 2271*a* to which opposite projections 2231 of the back plate 223 can be removably inserted. The paired support plates 2272 are inclined and converged toward the photosensitive drum 1.

Before the charging device thus constructed is used, the charging brush 220 is located outside the mounting member 2271. When used, the back plate 223 is inserted into the mounting member 2271, and the brush 220 is inserted between the support plates 2272. The brush 220 thus mounted contacts the surface of the drum 1. The upstream brush end is pushed inwardly by the support plate 2272 contacting it to be aligned and supported in the widthwise direction of the drum 1. The downstream brush end is also pushed inwardly by the support plate 2272 contacting it to be aligned and supported in the widthwise direction of the drum 1.

EMBODIMENT 23

Figure 28A:
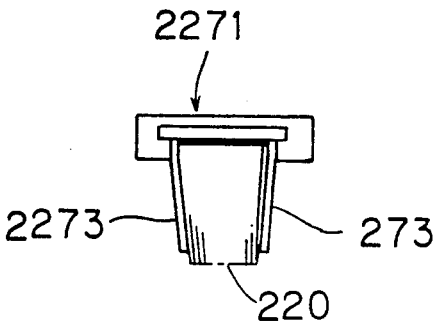
FIG. 28A is a side view of an embodiment 23.
Figure 28B:
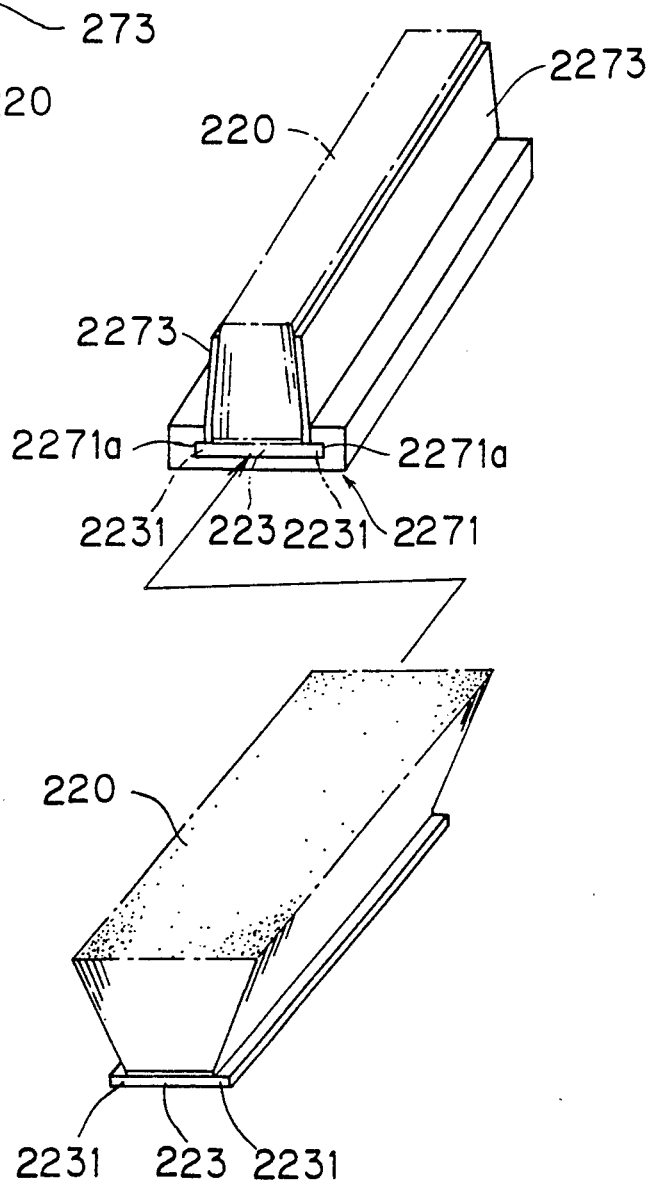
FIG. 28B is an exploded, perspective view of the same.

As shown in FIGS. 28A and 28B, the support plates 2272 in the embodiment 22 shown in FIGS. 27A and 27B are replaced with support plates 2273 fixed to the inner surfaces of the mounting member 2271.

EMBODIMENT 24

Figure 29:
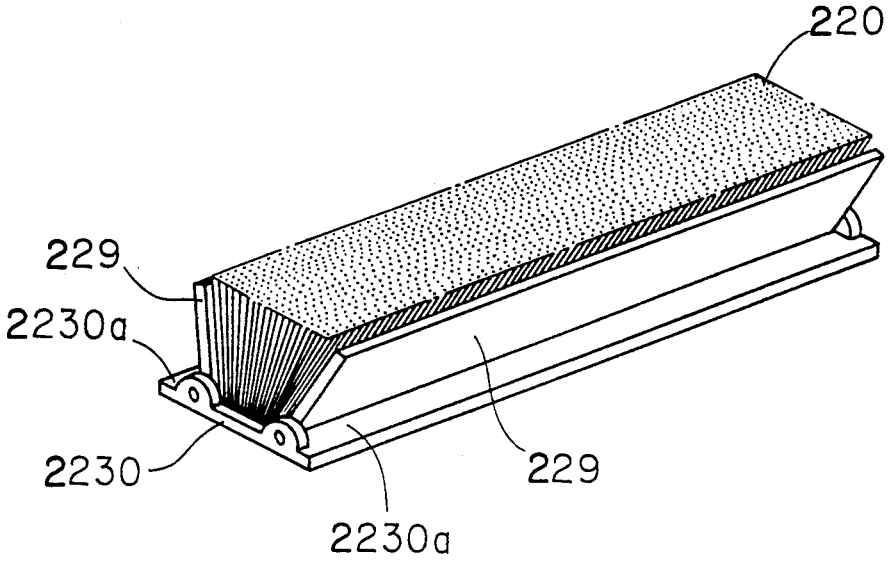
FIG. 29 is a perspective view of a charging brush as well as a back plate and brush end support plates for supporting the charging brush in an embodiment 24.
Figure 30A:
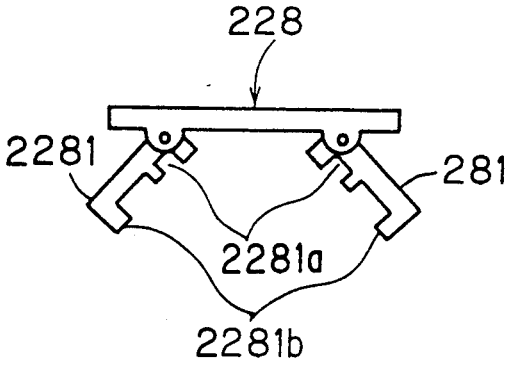
FIG. 30A is a side view of a unit to which a charging brush in FIG. 29 is attached.

As shown in FIG. 29, the charging brush 220 employed in the embodiment 19 is fixed to a back plate 2230 which is slightly larger than the back plate 223 in the embodiment 19, so that the back plate 2230 may be attached to a plate mounting unit 228 shown in FIG. 30A. Upstream and downstream brush end support plates 229 are disposed at the opposite sides of the charging brush 220, and are rotatably supported by the opposite projections 2230*a* of the plate 2230. The unit 228 is fixedly disposed above the photosensitive drum 1 of the printer, and has a pair of rotatable brush support arms 2281, which are provided at their inner surfaces with plate support portions 2281*a* and support plate holding portions 2281*b*.

Figure 30B:
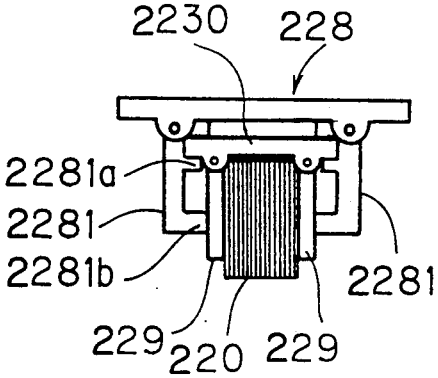
FIG. 30B is a side view of a charging brush attached to the unit.

Before the charging device thus constructed is used, the charging brush 220 is located outside the unit 228. When used, as shown in FIG. 30B, it is attached to the unit 228. The arms 2281 are closed, so that the plate support portions 2281*a* support the back plate 2230, and the support plate holding portions 2281*b* rotate the support plates 229 toward the brush 220. In this manner, the brush 220 contacts the surface of the drum 1. The upstream brush end is aligned and supported in the widthwise direction of the drum 1 by the support plate 229 contacting it, and the downstream brush end is also aligned and supported in the widthwise direction of the drum 1 by the support plate 229 contacting it.

EMBODIMENT 25

Figure 31:
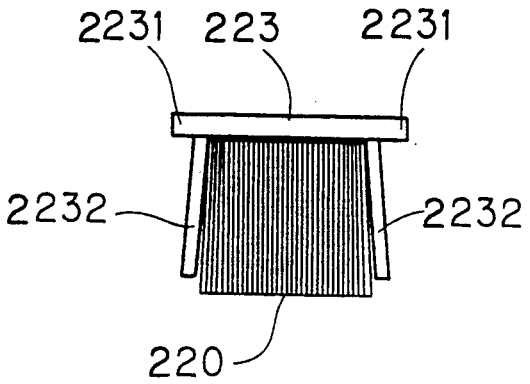
FIG. 31 is a side view of a charging brush as well as a back plate and brush end support plates for supporting the charging brush in an embodiment 25.
Figure 32A:
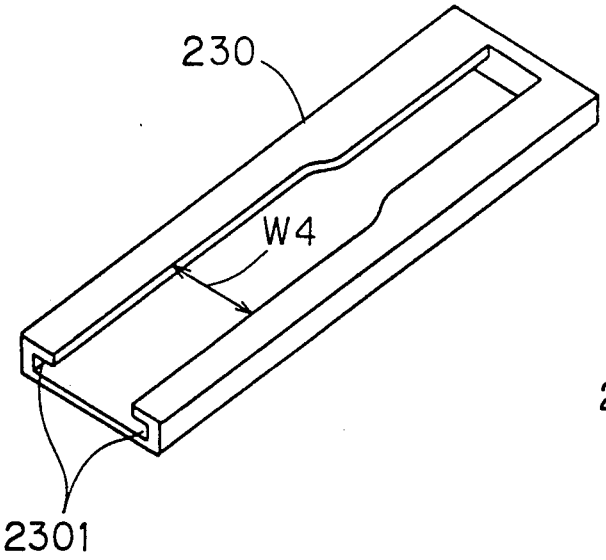
FIG. 32A is a perspective view of a guide rail to which a charging brush in FIG. 31 is attached.

As shown in FIG. 31, this embodiment includes the charging brush 220 and the back plate 223 supporting the same in the embodiment 19, as well as a guide rail 230 shown in FIG. 32A to which the plate 223 is removably attached. Flexible support plates 2232 for the upstream and downstream ends of the brush are disposed at the opposite sides of the charging brush 220. Each support plate 2232 is formed of an elastic polyethylene sheet of 0.7 mm in thickness. The support plates 2232 have upper ends which are fixed by adhesive to the opposite projections 2231 of the plate 223, and downstream ends which are spaced from the charging brush end.

The guide rail 230 is fixedly disposed above the photosensitive drum 1 of the printer, and has a pair of grooves 2301 into which the opposite projections 2231 of the back plate 223 is removably inserted. Each groove 2301 is open at one end and is closed at the other end. A space W4 between the grooves 2301 is large at the open side and is small at the closed side.

Figure 32B:
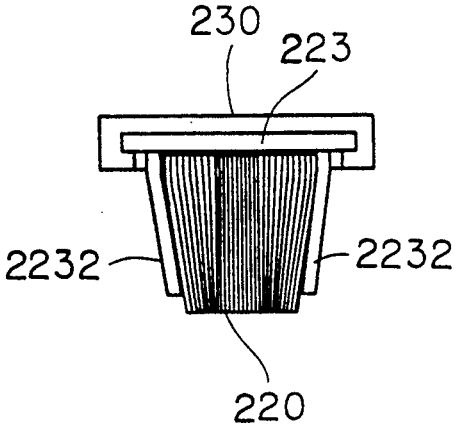
FIG. 32B is a side view of the brush in FIG. 31 attached to the rail.

Before the charging device thus constructed is used, the charging brush 220 is located outside the guide rail 230. When used, as shown in FIG. 32B, it is attached to the rail 230, so that the brush 220 contacts the surface of the drum 1. At the closed side of the grooves, the paired support plates 2232 are pushed toward the brush 220, so that the upstream and downstream brush ends are aligned and supported in the widthwise direction of the drum 1 by the support plates 2232 contacting them.

The guide rail 230 shown in FIG. 32A may be used to removably hold the charging brush shown in FIG. 29.

EMBODIMENT 26

Figure 33:
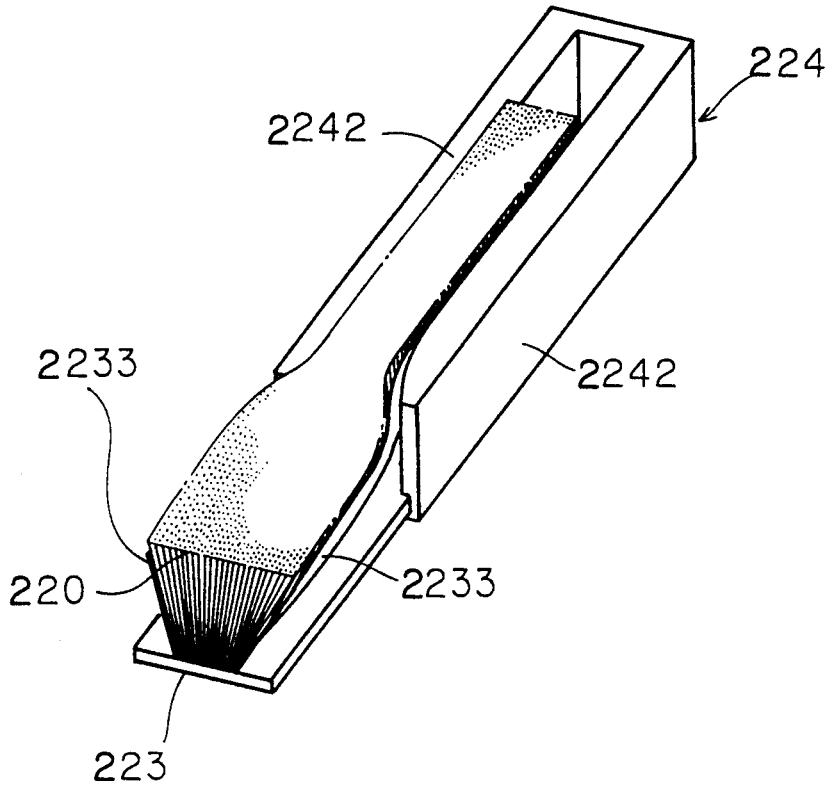
FIG. 33 is a perspective view of an embodiment 26.

As shown in FIG. 33, flexible films 2233 for supporting the upstream and downstream brush ends are disposed at the opposite sides of the charging brush 220 in the embodiment 19, and are fixed by adhesive to the back plate 223. The whole structure is removably inserted into the guide rail 224 in the embodiment 19 (FIG. 23A). The lower ends of the elastic films 2233 are separated from the charging brush end.

Before the charging device thus constructed is used, the charging brush 220 is located outside the guide rail 224. When used, it is attached to the rail 224, so that the brush 220 contacts the surface of the drum 1. The paired support films 2233 are pushed by the brush end support portions 2242 of the guide rail 224, so that the upstream and downstream brush ends are aligned and supported in the widthwise direction of the drum 1.

EXAMPLE 3 FOR COMPARISON

In this example, the flexible support plates 2232 which are employed in the embodiment 25 shown in FIGS. 31, 32A and 32B for supporting the upstream and downstream ends of the charging brush 220 are modified to have free or initial configurations. The modified plates 2234 converge downwardly to support and align the charging brush 220. Other structures are identical with those of the embodiment 25.

Figure 34:
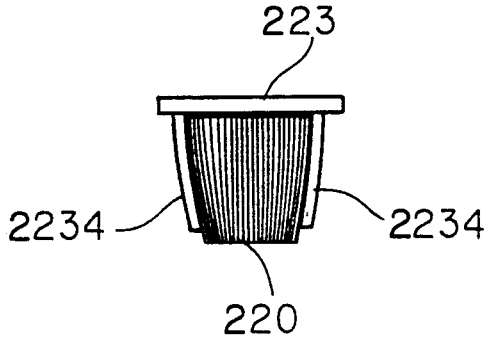
FIG. 34 is a side view of an example 3 for comparison.

The charging brushes 220 in the embodiments 19 and 25 in FIGS. 23B and 32B as well as the example 3 in FIG. 34 were left in an environment at a temperature of 55° C. and a humidity of 85% for 240 hours. Then, the brushes are attached to the guide rails, and a direct current voltage of about −1.1 KV was applied from the power supply PS through the back plates 223 for charging the surfaces of the photosensitive drum 1 to have a mean potential of about −750 V. Images of repetitive patterns were written and developed to toner images with the developing bias of −300 V. The toner images were printed out. The obtained results are as follows.

| | Results of Evaluation | |
|---|---|---|
| | Irregularity of Charging of Surface of Drum (ΔV) | Striped Noise in Image (σ) |
| Embodiment 19 | 115 V | 10 μm |
| Embodiment 25 | 120 V | 11 μm |
| Example 3 | 270 V | 68 μm |

As can be seen and considered from the above results of evaluation, the charging brushes in the embodiments are not subjected to unnecessary external forces due to the supporting means when they are stored before the use, so that accumulation of the stress in the brushes as well as deformation, solidification or the like thereof are prevented, which can prevents the irregular charging of the surface of the photosensitive drum 1 and the generation of the image noise when they are used.

EMBODIMENT 27

This charging device includes a charging brush 20 and a brush plate 23 as shown in FIG. 8, but does not employ support plates 24 and 25.

The brush hairs are formed of rayon fiber, which has an electrical resistivity of about $1\times10^5$ Ω.cm and contains conductive carbon powder at 12 wt.% with respect to the whole weight.

The bundles of this fiber 21, each including 50 hairs, are woven in the W-form into the base cloth 22 having the thickness of 0.5 mm, as shown in FIG. 6, to form the charging brush 20, which has the length L of 240 mm in the widthwise direction of the photosensitive drum, the width W of 7 mm, the height h1 of 7 mm, and the fiber density of 15000 pcs (hairs)/cm$^2$ in the central portion. The rear surface of the base cloth 22 is coated with electrically conductive adhesive, by which the base cloth 22 is fixed to the back plate 23 of aluminium having the thickness t of 1 mm.

Figure 35A:
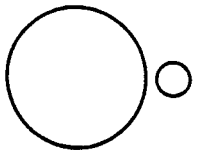
FIG. 35A is a view for illustrating a shape of a spinneret for rayon fiber used as a brush hair in an embodiment 27.
Figure 35B:
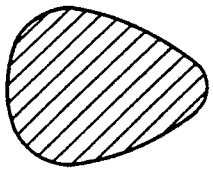
FIG. 35B is a cross section of rayon fiber obtained by the spinneret.

The rayon fiber is manufactured by a spinneret having a configuration shown in FIG. 35A. A section thereof is of a nearly egg-like shape having one round apex, as shown in FIG. 35B. An imaginary circle having the same area as the section of the fiber has a diameter of 19 μm.

EMBODIMENT 28

Figure 36A:
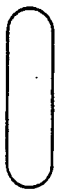
FIG. 36A is a view for illustrating a shape of a spinneret for rayon fiber used as a brush hair in an embodiment 28.
Figure 36B:
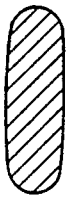
FIG. 36B, is a cross section of rayon fiber obtained by the spinneret.

The rayon fiber in the embodiment 27 is formed, using the spinneret having the configuration shown in FIG. 36A. The fiber thus formed has an oblong circular section having two round apexes, as shown in FIG. 36B. The diameter of the imaginary circle having the same area as the section of the fiber is 21 μm. The other structures are identical with those of the embodiment 27.

EMBODIMENT 29

Figure 37A:
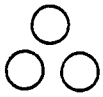
FIG. 37A is a view for illustrating a shape of a spinneret for rayon fiber used as a brush hair in an embodiment 29.
Figure 37B:
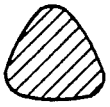
FIG. 37B is a cross section of rayon fiber obtained by the spinneret.

The rayon fiber in the embodiment 27 is formed, using the spinneret having the configuration shown in FIG. 37A. The fiber thus formed has a nearly triangular section having three round apexes, as shown in FIG. 37B. The diameter of the imaginary circle having the same area as the section of the fiber is 20 μm. The other structures are identical with those of the embodiment 27.

EMBODIMENT 30

Figure 38A:
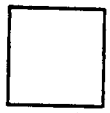
FIG. 38A is a view for illustrating a shape of a spinneret for rayon fiber used as a brush hair in an embodiment 30.
Figure 38B:
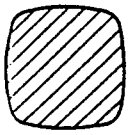
FIG. 38B is a cross section of rayon fiber obtained by the spinneret.

The rayon fiber in the embodiment 27 is formed, using the spinneret having the configuration shown in FIG. 38A. The fiber thus formed has a nearly square section having four round apexes, as shown in FIG. 38B. The diameter of the imaginary circle having the same area as the section of the fiber is 19 μm. The other structures are identical with those of the embodiment 27.

EMBODIMENT 31

Figure 39A:
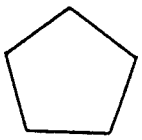
FIG. 39A is a view for illustrating a shape of a spinneret for rayon fiber used as a brush hair in an embodiment 31.
Figure 39B:
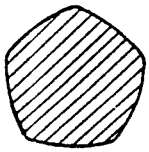
FIG. 39B is a cross section of rayon fiber obtained by the spinneret.

The rayon fiber in the embodiment 27 is formed, using the spinneret having the configuration shown in FIG. 39A. The fiber thus formed has a nearly pentagonal section having five round apexes, as shown in FIG. 39B. The diameter of the imaginary circle having the same area as the section of the fiber is 20 μm. The other structures are identical with those of the embodiment 27.

EMBODIMENT 32

Figure 40A:
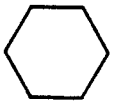
FIG. 40A is a view for illustrating a shape of a spinneret for rayon fiber used as a brush hair in an embodiment 32.
Figure 40B:
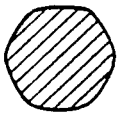
FIG. 40B is a cross section of rayon fiber obtained by the spinneret.

The rayon fiber in the embodiment 27 is formed, using the spinneret having the configuration shown in FIG. 40A. The fiber thus formed has a nearly hexagonal section having six round apexes, as shown in FIG. 40B. The diameter of the imaginary circle having the same area as the section of the fiber is 20 μm. The other structures are identical with those of the embodiment 27.

EMBODIMENT 33

The diameter of the imaginary circle having the same area as the section of the fiber is 10 μm. The fiber has a sectional shape similar to that of the rayon fiber in the embodiment 28. The other structures are identical with those of the embodiment 27.

EMBODIMENT 34

The diameter of the imaginary circle having the same area as the section of the fiber is 40 μm. The fiber has a sectional shape similar to that of the rayon fiber in the embodiment 28. The other structures are identical with those of the embodiment 27.

EMBODIMENT 35

The diameter of the imaginary circle having the same area as the section of the fiber is 10 μm. The fiber has a sectional shape similar to that of the rayon fiber in the embodiment 32. The other structures are identical with those of the embodiment 27.

EMBODIMENT 36

The diameter of the imaginary circle having the same area as the section of the fiber is 40 μm. The fiber has a sectional shape similar to that of the rayon fiber in the embodiment 32. The other structures are identical with those of the embodiment 27.

EXAMPLE 4 FOR COMPARISON

Figure 41A:
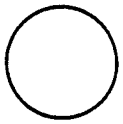
FIG. 41A is a view for illustrating a shape of a spinneret for rayon fiber used as a brush hair in an example 4 for comparison.
Figure 41B:
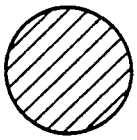
FIG. 41B is a cross section of rayon fiber obtained by the spinneret.

The rayon fiber in the embodiment 27 is formed by the spinneret shown in FIG. 41A. The fiber thus formed has a circular section of 20 μm in diameter, as shown in FIG. 41B. The other structures are identical with those of the embodiment 27.

EXAMPLE 5 FOR COMPARISON

Figure 42A:
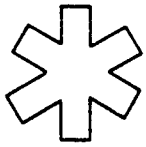
FIG. 42A is a view for illustrating a shape of a spinneret for rayon fiber used as a brush hair in an example 5 for comparison.
Figure 42B:
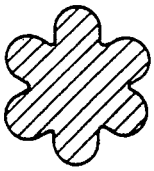
FIG. 42B is a cross section of rayon fiber obtained by the spinneret.

The rayon fiber in the embodiment 27 is formed by the spinneret shown in FIG. 42A. The fiber thus formed has a star-shaped section, as shown in FIG. 42B. The diameter of the imaginary circle having the same area as the section of the fiber is 19 μm. The other structures are identical with those of the embodiment 27.

The embodiments 27–36 and the examples 4 and 5 were respectively assembled in the printer shown in FIG. 3. The direct current voltage of about −1.1 KV was applied from the power supply PS through the back plate 23 of aluminium for charging the surface of the photosensitive drum 1 to have a mean potential in a range from about −700 V to about −800 V. Images of repetitive patterns were written and developed to toner images with the developing bias of −300 V. The toner images were printed out. The image noises (striped noises) were evaluated in the manner described before in the initial printing operation and after the printing of 5000 sheets. The obtained results are shown in Table 5.

TABLE 5

| | Shape of Spinneret | Shape of Section of Brush Hair | Diameter of Imaginary Circle (μm) | Initial Striped Image Noise (σ μm) |
|---|---|---|---|---|
| Em. 27 | FIG. 35A | FIG. 35B | 19 | Δ (25) |
| Em. 28 | FIG. 36A | FIG. 36B | 21 | ○ (18) |
| Em. 29 | FIG. 37A | FIG. 37B | 20 | ◎ (5) |
| Em. 30 | FIG. 38A | FIG. 38B | 19 | ◎ (5) |
| Em. 31 | FIG. 39A | FIG. 39B | 20 | ○ (15) |
| Em. 32 | FIG. 40A | FIG. 40B | 20 | Δ (27) |
| Em. 33 | FIG. 36A | FIG. 36B | 10 | ○ (16) |
| Em. 34 | FIG. 36A | FIG. 36B | 40 | ○ (18) |
| Em. 35 | FIG. 40A | FIG. 40B | 10 | Δ (22) |
| Em. 36 | FIG. 40A | FIG. 40B | 40 | Δ (30) |
| Ex. 4 | FIG. 41A | FIG. 41B | 20 | X (55) |
| Ex. 5 | FIG. 42A | FIG. 42B | 19 | Δ (34) |

In Table 5, "Em." means "embodiment" and "Ex" means "example". As can be seen from Table 5, the image noise at the initial printing operation is not substantially found or maintained in a level causing no practical problem in the embodiments 27–36. This means that the brush hairs have convex polygonal shapes or the like, in which the charging points are increased in number, so that the regular and uniform charging can be performed stably.

It also can be found that the good charging can be performed if the diameter of the imaginary circle having the same area as the section of the brush hair is at least in a range from 10 μm to 40 μm.

Conversely, the example 4 employs the brush hairs having the circular sections and thus has less charging points, so that the image noise is generated even at the initial printing operation. In the example 5, since there are excessively many charging points, the charging points cannot be definitely formed, and also fine powder enters the concave portions on the peripheral surfaces of the brush hairs. Therefore, the charging performance is deteriorated and the striped image noise is caused.

In the invention, the hairs may have sections of the various convex polygonal sections, other than those described before.

The convex polygonal section has no concave portion and is defined by a contour formed of only outwardly convex portions. A number of the convex portions in the polygonal section is not restricted, but is substantially and preferably in a range from one to ten, and more preferably from two to five. The number larger than ten excessively approaches the polygon or the like to a circle, which reduces an expected effect for increasing the charging points.

Material of the brush hairs according to the invention is not restricted to particular material. However, it is required to have appropriate electrical conductivity.

Such conductive material may be metal wires of tungsten, stainless steel, gold, platinum, iron, copper, aluminium and others.

Conductive resin material may be formed of fiber and resistance adjusting agent dispersed therein. The fiber may be formed of rayon, nylon, acetate, cuprammonium, vinylidene, vinylon, ethylene fluoride, promix, benzoate, polyurethane, polyester, polyethylene, polyvinyl chloride, polychlal, polynosic, polypropylene and others. The resistance adjusting agent may be carbon black, carbon fiber, metal powder, metal whiskers, metal oxide, semiconductor and others. An appropriate resistance may be obtained by adjusting the amount of the resistance adjusting agent dispersed in the fiber.

Instead of dispersion, the surface of the fiber may be covered with the resistance adjusting agent.

The invention is not restricted to the embodiments 27–36 described before, and may be embodied with the brush hairs having various sectional shapes and/or in the other various forms.

Figure 43:
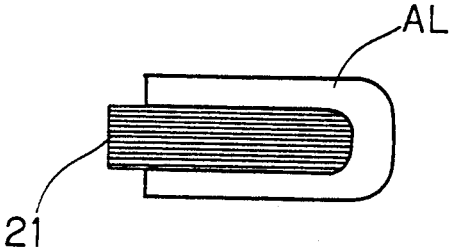
FIG. 43 is a perspective view of still another example of a charging brush according to the invention.

For example, as shown in FIG. 43, the brush hairs 21 may be held between pinching members or plates of aluminium or the like.

Figure 44:
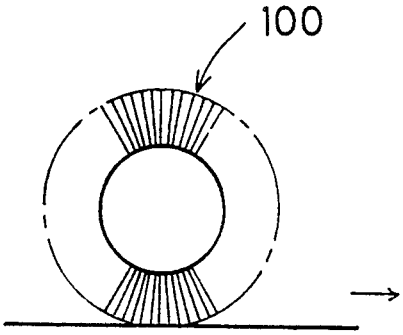
FIG. 44 is a schematic side view of a rotary brush charging device to which the invention is applicable.

The inventions may be applied not only to the brush charging device of the stationary type but also to the brush charging device 100 of a rotary type shown in FIG. 44.

A plurality of brush charging devices may be disposed around the photosensitive drum 1 in FIG. 3, in which case the brush charging device according to one of the embodiments 1–36 may be preferably applied at least to the charging device located at the upstream end in the rotating direction of the drum.

Although the present invention has been described and illustrated in detail, it is clearly understood that the same is by way of illustration and example only and is not to be taken by way of limitation, the spirit and scope of the present invention being limited only by the terms of the appended claims.

We claim:

1. A contact charging device for charging a moving surface of an electrostatic latent image support member comprising:

brush hairs contacting said moving surface of said electrostatic latent image support member;

a brush restricting member, which is disposed upstream of said brush hairs with respect to a moving direction of said moving surface of said electrostatic latent image support member and contacts said brush hairs;

said brush hairs project from free ends of said brush restricting member toward said moving surface by a length in a range of 0.3 mm to 2.5 mm; and means which applies a voltage to said brush hairs for charging said moving surface of said electrostatic latent image support member.

2. A contact charging device according to claim 1, wherein said brush restricting member has a portion inclined from an upstream portion toward a downstream portion with respect to the moving direction of said moving surface, and said inclined portion contacts said brush hairs.

3. A contact charging device according to claim 2, wherein said inclined portion of said brush restricting member is formed to be at an angle in a range from 15 degrees to 45 degrees with respect to a normal line of said moving surface of said electrostatic latent image support member.

4. A contact charging device according to claim 1, wherein said brush restricting member is made from metal.

5. A contact charging device according to claim 1, wherein said brush restricting member is made from resin.

6. A contact charging device according to claim 1, wherein said a portion of said brush restricting member which contacts said brush hairs has a rough surface.

7. A contact charging device according to claim 6, wherein a maximum surface roughness $R_{max}$ of said rough surface of said brush restricting member is in a range from 2.0 μm to 40 μm according to JIS-B-0601-1970.

8. A contact charging device according to claim 1, further comprising a brush restricting member, which is disposed downstream of said brush hairs with respect to the moving direction of said moving surface of said electrostatic latent image support member, and contacts said brush hairs.

9. A contact charging device for charging a moving surface of an electrostatic latent image support member, comprising:

a group of a large number of brush hairs, which extends in a first direction perpendicular to a moving direction of a tangential plane with respect to said moving surface and contacts said moving surface of said electrostatic latent image support member;

brush restricting members which are located at opposite ends of a second direction perpendicular to said moving direction, and are disposed along a direction parallel to said moving direction of said moving surface to contact said brush hairs; and means which applies a voltage to said group of said brush hairs for charging said moving surface of said electrostatic latent image support member.

10. A contact charging device according to claim 9, further comprising a brush restricting member, which is disposed upstream to said group of said brush hairs in said moving direction of said moving surface, and contacts said brush hairs.

11. A contact charging device used in an image forming apparatus including a movable electrostatic latent image support member for charging a surface of said electrostatic latent image support member, comprising:

a brush hair group formed of a large number of brush hairs contacting said surface of said electrostatic latent image support member, said brush hair group extending in a direction crossing a moving direction of said electrostatic latent image support member;

a brush holder member holding said brush hair group;

holding means which is disposed in said image forming apparatus for removably holding said brush holder member between a mounted position and an escaped position;

support means which applies a force in said moving direction of said electrostatic latent image support member to said brush hair group for deforming the same when said brush holder member is held at said mounted position, and releases said force for inhibiting deformation of said brush hair group when said brush holder member is held at said escaped position; and means for applying a voltage for charging said electrostatic latent image support member when said brush holder member is held at said mounted position.

12. A contact charging device according to claim 11, wherein said support means includes:

an opening which is disposed in said image forming apparatus for receiving said brush holder member and said brush hair group therein; and a groove extending in a mounting direction for receiving said brush holder member and said brush hair group, said mounting direction being directed from said opening to a position at which said brush holder member is full mounted, and a section of said groove in a direction perpendicular to said mounting direction having an area which gradually decreases in said mounting direction such that said brush hair group is deformed by a force applied by an inner wall of said groove in said moving direction of said electrostatic latent image support member when said brush holder member is being mounted.

13. A contact charging device according to claim 12, wherein said brush holding member includes:

a plate member for holding said brush hair group; and an elastic thin film which is provided in said plate member to contact said brush hair group along said mounting direction of said brush hair group.

14. A contact charging device according to claim 11, wherein said support means includes:

a brush support member, which is disposed near said holding means in said image forming device, and is inclined to be pressed against said brush hair group at said mounting position such that said brush hair group is deformed by a force applied in said moving direction of said electrostatic latent image support member by said brush support member when said brush holder member is mounted in said mounted position.

15. A contact charging device according to claim 11, wherein said support means includes:

a first brush support member which is disposed in said brush holder member, and is rotatable around a rotation axis between a contact position, at which said first brush support member contacts said brush hair group to deform said brush hair group, and a noncontact position, at which said first brush support member does not contact said brush hair group and thus does not deform said brush hair group; and a second brush support member, which is disposed in said image forming apparatus, and is connected to said brush holding member at a position, at which said brush holder member is mounted at said mounted position of said holding means, to rotate said first brush support member from said noncontact position to said contact position.

16. A contact charging device according to claim 11, wherein said support means includes:

a support plate having an opening, which allows contact of said brush hair group with said surface of said electrostatic latent image support member when said brush holder member is mounted at said mounted position by said holding means, said opening provided in said support plate having an area which gradually decreases in a mounting direction directed from said escaped position to said mounted position such that said brush hair group is deformed by a force applied by said support plate in said moving direction of said electrostatic latent image support member when said brush holder member is being mounted in said mounted position.

17. A contact charging device according to claim 16, wherein said brush holding member includes:

a plate member for holding said brush hair group; and an elastic plate provided in said plate member and disposed along said mounting direction of said brush hair group to contact said brush hair group.

18. A contact charging device used in a process cartridge which is removably mounted in an image forming apparatus, and includes an electrostatic latent image support member having a movable surface, said contact charging device comprising:

a brush hair group formed of a large number of brush hairs contacting said movable surface of said electrostatic latent image support member, said brush hair group extending in a direction crossing a moving direction of said movable surface;

an electrically conductive brush holder member holding said brush hair group, said brush holder member being removable from the process cartridge;

holding means which is disposed in said process cartridge for removably holding said brush holder member at a mounted position in said process cartridge and an escaped position separate from said process charger;

power supply means which is provided in the image forming apparatus for applying a voltage for charging said electrostatic latent image support member to said brush hair group when said brush holder member is held at said mounted position; and a terminal provided in said process cartridge, said terminal being electrically coupled to said power supply means when mounted in said image forming apparatus and electrically coupling said power supply means with said brush holder member when said brush holder member is held at said mounted position.

19. A contact charging device according to claim 18, further comprising support means which applies a force in said moving direction of said movable surface to said brush hair group for deforming the same when said brush holder member is located at said mounted position, and releases said force for inhibiting deformation of said brush hair group when said brush hair holder member is held at said escaped position.

20. A contact charging device according to claim 19, wherein said support means includes:

an opening provided in said process cartridge for receiving said brush holder member and said brush hair group therein; and a groove extending in a mounting direction for receiving said brush holder member and said brush hair group, said mounting direction being directed from said opening to a position at which said brush holder member is fully mounted, and a section of said groove in a direction perpendicular to said mounting direction having an area which gradually decreases in said mounting direction such that said brush hair group is deformed by a force applied in said moving direction of said electrostatic latent image support member when said brush holder member is being mounted.

21. A contact charging device comprising:

a power supply;

holder member electrically coupled to said power supply; and a large number of brush hairs held by said holder member, said brush hairs each having a polygonal section which has a contour formed only of outwardly convex portions.

22. A contact charging device according to claim 21, wherein said brush hairs each have a sectional area which is equal to an area of an imaginary circle having a diameter in a range from 10 $\mu$m to 40 $\mu$m.

23. A contact charging device according to claim 21, wherein a number of said convex portions of each brush hair is in a range form one to ten.

24. A process cartridge which is removably mounted in an image forming apparatus, and includes an electrostatic latent image support member having a movable surface, said process charger including a contact charging device that comprises:

a brush hair group formed of a large number of brush hairs contacting said movable surface of said electrostatic latent image support member, said brush hair group extending in a direction crossing a moving direction of said movable surface;

an electrically conductive brush holder member holding said brush hair group, said brush holder member being removable from the process cartridge;

holding means which is disposed in said process cartridge for removably holding said brush holder member at a mounted position in said process cartridge and an escaped position separate from said process charger;

power supply means which is provided in the image forming apparatus for applying a voltage for charging said electrostatic latent image support member to said brush hair group when said brush holder member is held at said mounted position; and a terminal provided in said process cartridge, said terminal being electrically coupled to said power supply means when mounted in said image forming apparatus and electrically coupling said power supply means with said brush holder member when said brush holder member is held at said mounted position.

25. A process cartridge which is removably mounted in an image forming apparatus, and includes an electrostatic latent image support member having a movable surface, said process charger including a contact charging device that comprises:

a brush hair group formed of a large number of brush hairs contacting said movable surface of said electrostatic latent image support member, said brush hair group extending in a direction crossing a moving direction of said movable surface;

a brush holder member holding said brush hair group, said brush holder member being removable from the process cartridge;

holding means which is disposed in said process cartridge for removably holding said brush holder member at a mounted position in said process cartridge and an escaped position separate from said process charger; and power supply means which is provided in the image forming apparatus for applying a voltage for charging said electrostatic latent image support member to said brush hair group when said brush holder member is held at said mounted position.

* * * * *